US005946897A

United States Patent [19]

Ichikawa et al.

[11] Patent Number: 5,946,897

[45] Date of Patent: Sep. 7, 1999

[54] PRODUCTION UNIT FOR TWISTED CABLE

[75] Inventors: Masaharu Ichikawa; Hideki Nakamura, both of Yokkaichi, Japan

[73] Assignee: Sumitomo Wiring Systems, Ltd., Yokkaichi, Japan

[21] Appl. No.: 09/090,311

[22] Filed: Jun. 4, 1998

[30] Foreign Application Priority Data

Jun. 5, 1997 [JP] Japan ..... 9-148249

[51] Int. Cl.[6] ..... D01H 7/02

[52] U.S. Cl. ..... 57/25; 57/59; 57/60; 57/64; 57/311; 57/314; 57/906; 140/149

[58] Field of Search ..... 57/25, 26, 27, 57/59, 60, 61, 64, 311, 314, 906; 140/149

[56] References Cited

U.S. PATENT DOCUMENTS

| | | | |
|---|---|---|---|
| 3,151,437 | 10/1964 | Schlein | 57/25 |
| 3,704,578 | 12/1972 | Myers | 57/1 R |
| 3,827,465 | 8/1974 | Loy et al. | 140/149 |
| 3,831,361 | 8/1974 | Ullmann | 57/25 |
| 4,655,033 | 4/1987 | Christian et al. | 57/11 |
| 5,852,924 | 12/1998 | Mulligan | 57/25 |

FOREIGN PATENT DOCUMENTS

| | | |
|---|---|---|
| 63-29819 | 2/1988 | Japan . |
| 63-33516 | 3/1988 | Japan . |
| 5-41327 | 6/1993 | Japan . |

*Primary Examiner*—William Stryjewski
*Assistant Examiner*—Gina Silverio
*Attorney, Agent, or Firm*—Greenblum & Bernstein, P.L.C.

[57] ABSTRACT

A production unit for twisted cable is disclosed that facilitates the supply and removal of fixed length cables, thereby contributing to improved workability and automation compatibility. A plurality of pairs of relatively rotatable opposed cable clamps are provided with one cable clamp of each pair provided at one end of the fixed length cables and the other of each pair of cable clamps provided at the other end. Each pair of clamps is intermittently moved forward in a direction transverse to the opposed direction in which the cables extend. Each pair of cable clamps sequentially circulate, and the supply and removal operation of fixed length cables to and from the pairs of clamps are conducted respectively at predetermined positions by stations provided in the circulating route, by which it becomes possible to carry out the supply and removal of fixed length cables to continuously repeat the twisting operation.

11 Claims, 27 Drawing Sheets

MAGNETIC TYPE RODLESS CYLINDER

PRODUCTION UNIT FOR TWISTED CABLE

BACKGROUND OF THE INVENTION

1. Field of the Invention

The present invention relates to a production unit for twisted cables.

2. Description of Background Information

Twisted cables, which are in general adapted for a signal line and the like, are produced by twisting together a pair of fixed length cables with both ends clamped.

In order to twist together the fixed length cables, it is necessary to apply twists relatively in reverse direction several times with both ends of the fixed length cable clamped. For this purpose, cable twisting apparatus for producing twisted cables is known.

In the conventionally adopted cable twisting apparatus, plural pairs of wires forming each cable are mounted between one end side of cable clamps for clamping an end of the fixed length cable and the other end side of cable clamps for clamping the other end of each cable. The cables are arranged in parallel, and the cables on one side are driven in rotation with a drive unit provided on the cable clamps thereof, and the cables on the other side are fixed by the cable clamps thereof, so that relatively inverse twists are imparted.

In the cable twisting apparatus as described above, both the cable clamps on the driving side and the cable clamps on the fixed side are only placed in parallel at fixed positions. Accordingly, in carrying out the mounting and removal of the fixed length cables to and from the cable clamps, the workers are required to move to the place where the individual cable clamps are set up. As a result, there have been drawbacks of not only poor workability but also a lack of automation of the cable twisting process.

SUMMARY OF THE INVENTION

The present invention has been made in light of the above drawbacks, and its objects are to make the mounting and removal of the fixed length cable easy, and provide a unit for producing the twisted cables which is suited for improvement of operation and automation compatibility.

In order to solve the above problems, the present invention provides a production unit for twisted cable including parallel arrangements of a plurality of opposed pairs of cable clamps, one of each pair for holding one end of a fixed length cable and the other clamp for holding the other end being provided. One cable clamp of each pair is rotatably driven by a drive unit and the other cable clamp of each pair is fixed, thereby imparting relative rotation to both wires of each cable to give twists to each clamped fixed length cables. The invention further includes a forward movement mechanism provided for intermittently advancing each pair of cable clamps in the direction traverse to the length direction of the cables. A supply station for supplying the fixed length cable to the cable clamp on the upstream side is provided, as is a removing station for removing the fixed length cable from the cable clamps.

A rearward movement mechanism is also provided which forms an endless carrying channel with the carrying route defined by the forward movement mechanism and for moving each cable clamp rearwardly which had been moved forward.

According to the present invention, each pair of cable clamps is sequentially circulated by the forward movement mechanism and the rearward movement mechanism, and the supply operation and the removing operation of the fixed length cables are carried out at fixed positions, respectively, by which it becomes possible to repeat the twisting operation.

Also, in a preferred embodiment, drive units are installed at a plurality of fixed positions to meet plural pairs of cable clamps which move forward, and a motive force transmitting device for transmitting the motive force of the drive unit to the cable clamp on the drive side is provided so that each pair of the cable clamps which are moved forward by the forward movement mechanism undergo relative rotation.

According to another feature of the present invention, twist processing can be provided to the fixed length cable by rotating the cable clamp by the drive unit located at the fixed position.

Also, in a preferred embodiment, the system further includes a straightening device for removing deformation from the cable by drawing the fixed length cables which are provided on the supply station and delivered to the cable clamps in the supply station.

According to another feature of the present invention, because the fixed length cables are delivered to and received by the cable clamps under the condition of being linearly straightened by the straightening device, the precision of the twist formation is improved in the twisting process to be described later.

Also, in another preferred embodiment, the straightening device includes a fixing mechanism for fixing one end respectively of a pair of fixed length cables, a guide device which enters between a pair of fixed length cables, and a clamping part for clamping each fixed length cable in rolling contact between the guide device and one of the clamping parts. A reciprocating device for reciprocating the guide part and the clamp part integrally along the lengthwise direction of the fixed length cables, is provided. The invention further includes a clamping part driving mechanism for driving the clamping part to a clamping position for clamping the fixed length cable during the forward movement and to a releasing position for releasing the fixed length cable at the time of the backward movement.

A further feature of the present invention includes a straightening device for a pair of the fixed length cables wherein the straightening operation can be performed in a reciprocal motion at one time.

Especially, it is preferred for the fixing mechanism to also act as a carrying device for carrying an end part of the fixed length cable to the corresponding cable clamp.

According to another feature of the present invention, the fixed length cable which has passed through the straightening step can be delivered to the cable clamp without requiring a re-clamping.

In another embodiment, the drive unit twists the fixed length cable in an amount greater than the predetermined twisting amount from the upstream side to the downstream side of the forward movement mechanism, followed by twisting the cable in a reverse direction by a predetermined amount at the downstream end of the forward movement mechanism.

In a further aspect of the present invention, the reactant of the fixed length cable in the direction of return formed in twisting the cable in one direction is removed during twisting in the reverse direction, and the fixed length cable exhibits plastic deformation under the condition of being twisted by the desired twisting amount.

BRIEF DESCRIPTION OF THE DRAWINGS

The present invention is further described in the detailed description which follows, by reference to the noted plurality of drawings by way of non-limiting examples or preferred embodiments of the present invention, in which like reference numerals represent similar parts throughout the illustrations and wherein:

FIGS. 5(A) and 5(B) show features of the clamp of the straightening unit, wherein FIG. 5(A) is a front view, and FIG. 5(B) is a left side view;

DETAILED DESCRIPTION OF THE INVENTION

Referring to the appended drawings, preferred embodiments of the present invention will be described below.

Figure 1:
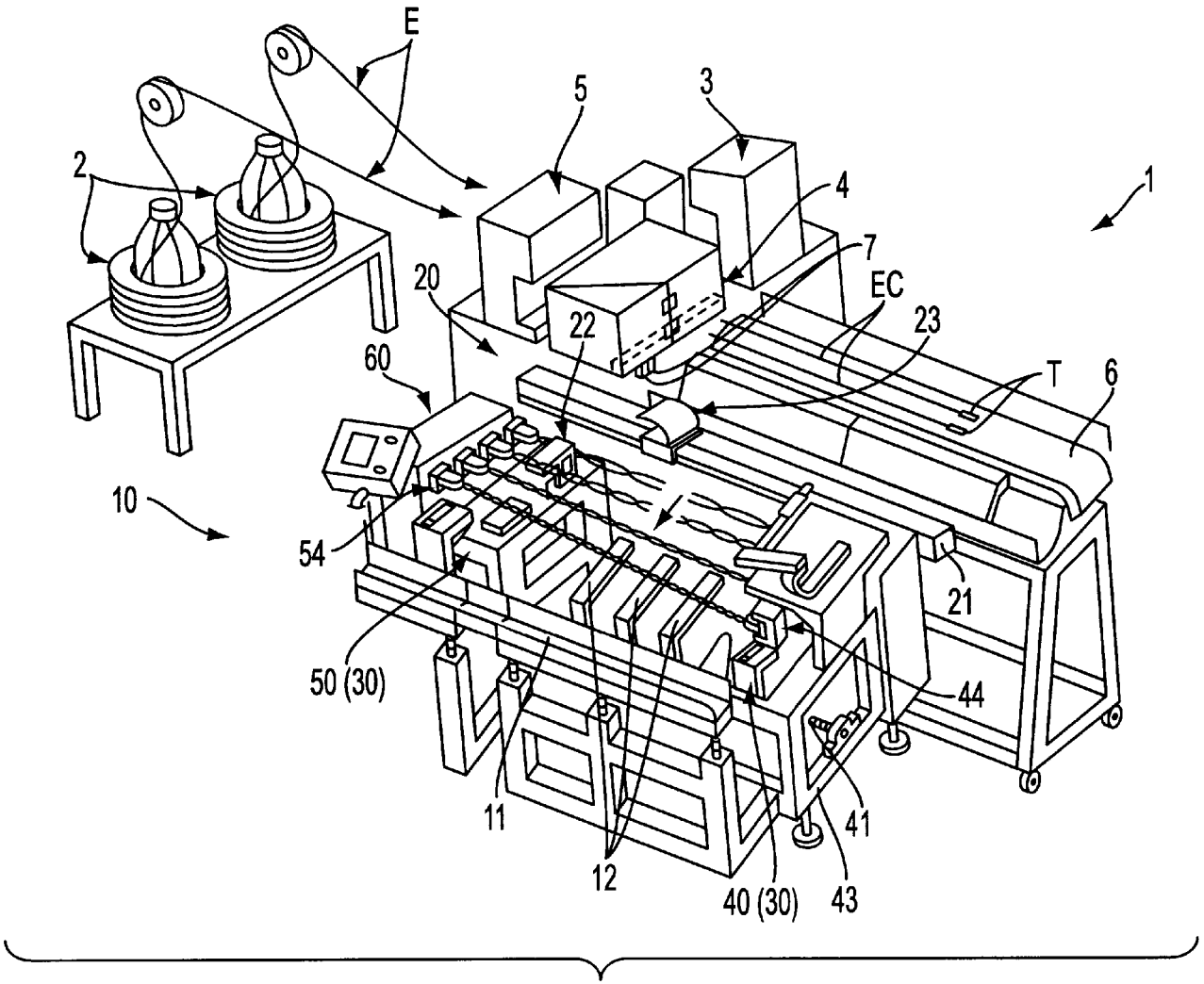
FIG. 1 is a perspective view showing a schematic construction of the production unit for twisted cable in one embodiment of the present invention.
Figure 2:
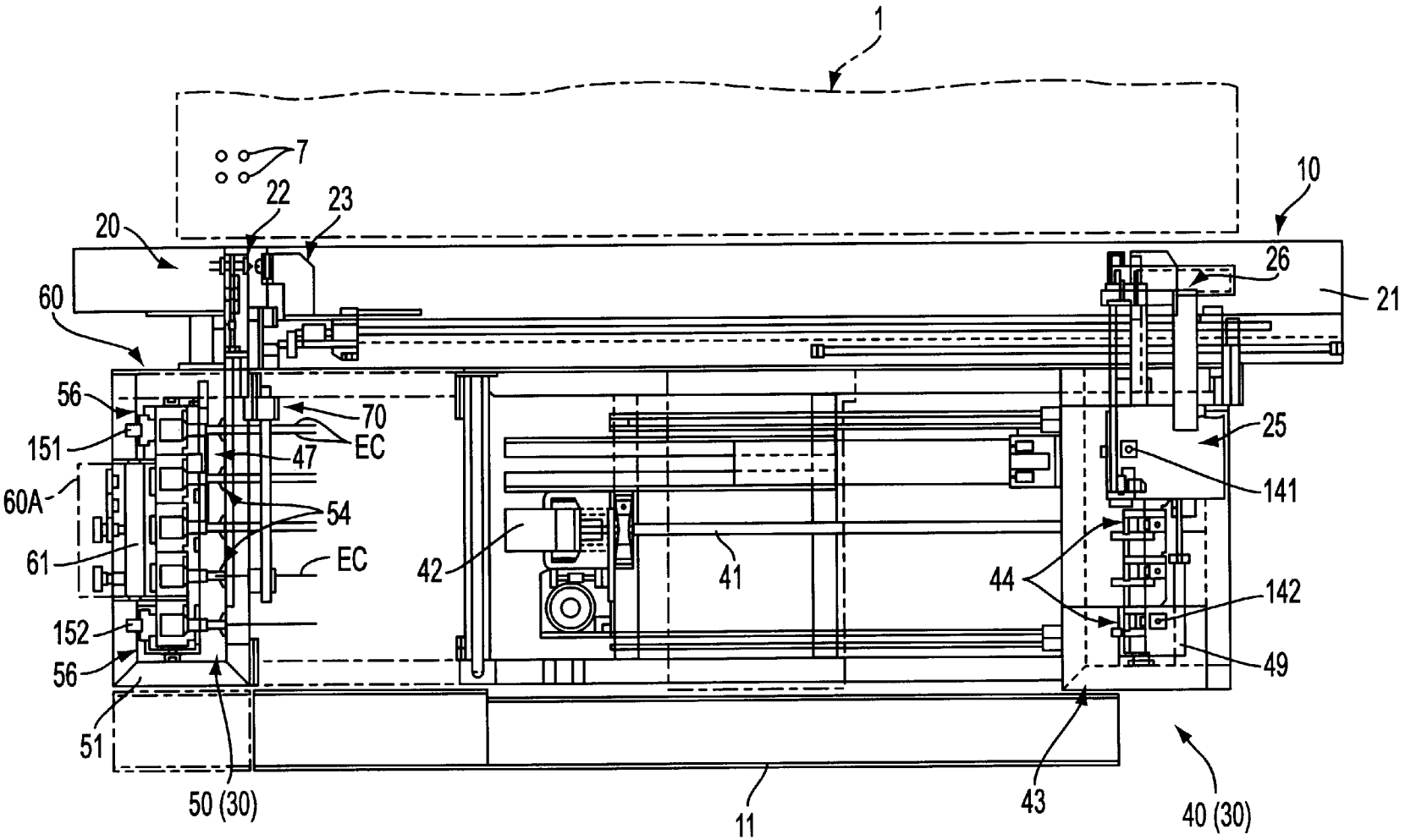
FIG. 2 is a plan view of the production unit for twisted cable of FIG. 1.
Figure 3:
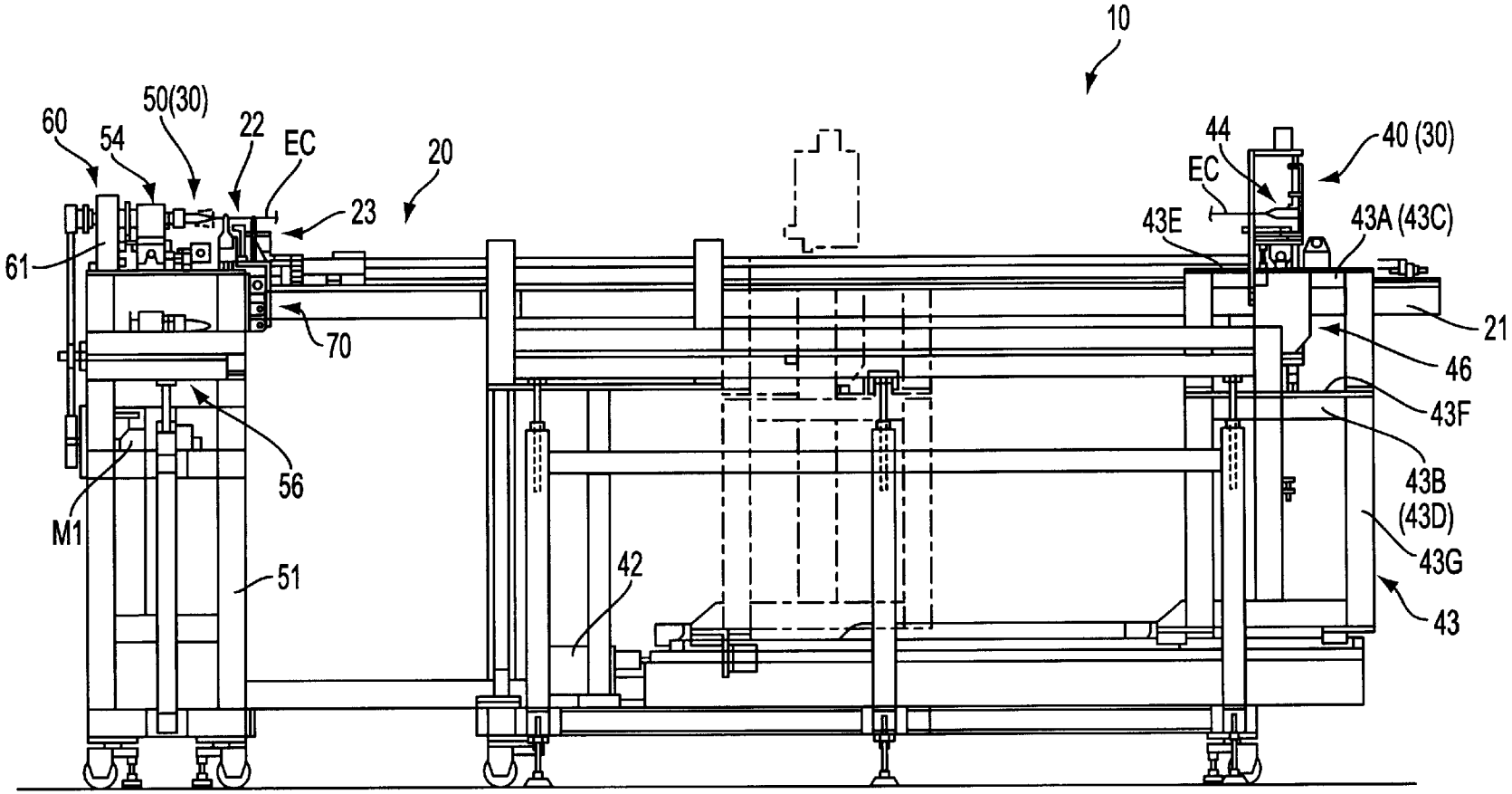
FIG. 3 is a front elevation of the production unit for twisted cable of FIG. 1.

FIG. 1 is a perspective view showing a schematic construction of the production unit 10 for twisted cable in one embodiment of the present invention, FIG. 2 is a plan view of the production unit 10 of FIG. 1, and FIG. 3 is a front view of the production 10 of FIG. 1.

First, referring to FIG. 1, the production unit 10 for twisted cable shown in this figure is installed along with a fixed length cable production unit 1. The fixed length cable production unit 1 for forming fixed length cable is well known and includes an A-end terminal press fitting apparatus 3 for press fitting metal termination fittings T to the ends of coated wires E reeled out respectively from a pair of cable reels 2 provided in a unit of two reels. Also provided are a cutting unit 4 for reeling out the coated wires E after press fitting the terminal fittings and cutting the wires into the fixed length wires EC of predetermined length, a B-end terminal press-fitting apparatus 5 for press-fitting a metal terminal fitting T to the terminal end of each cut coated wires E, and a conveyor 6 for discharging the coated wires E having a metal terminal fitting T press fitted on the ends thereof (hereinafter to be referred to simply as "fixed length cable EC").

Figure 4:
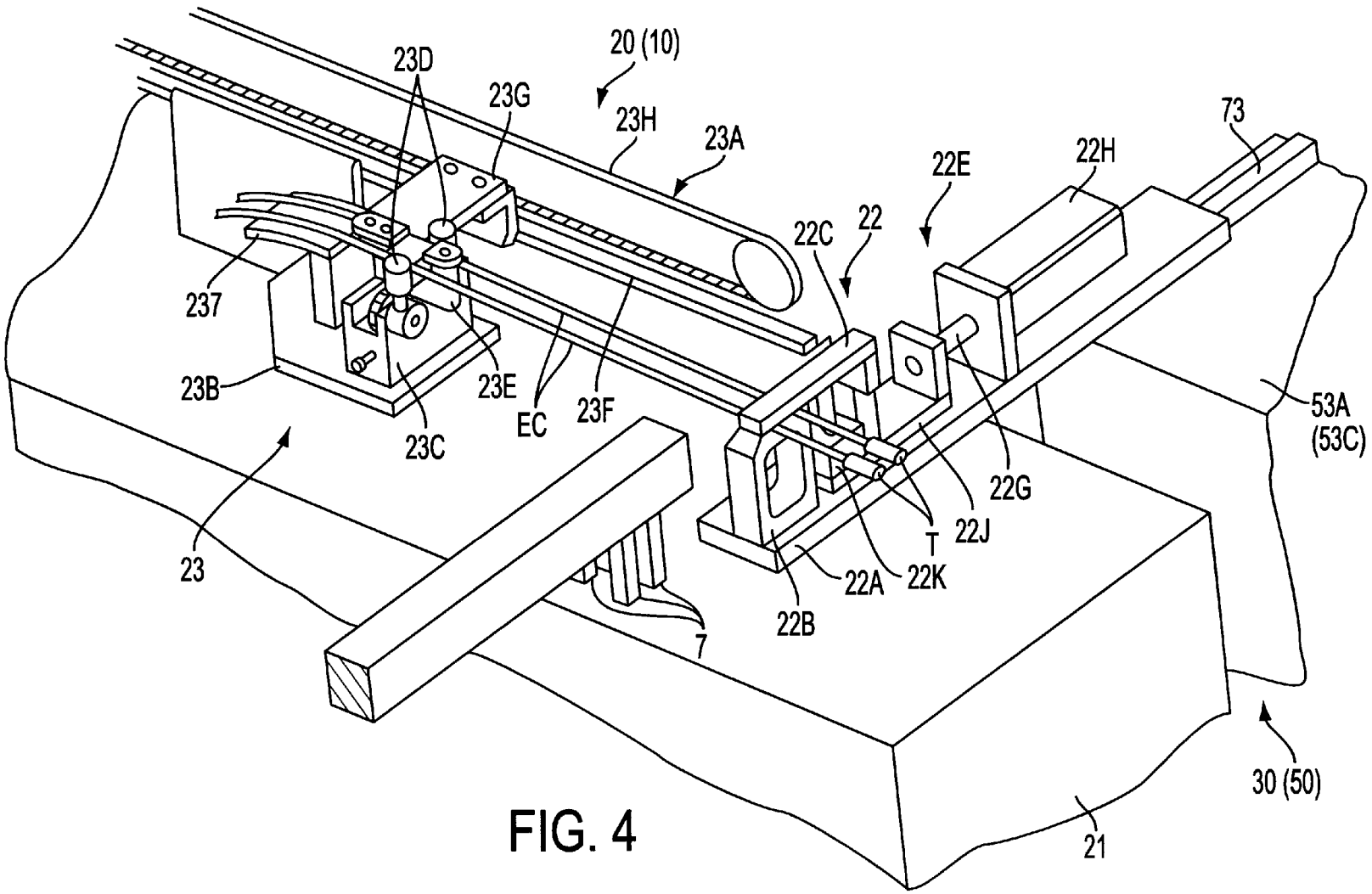
FIG. 4 is a perspective view showing the essential parts of the straightening unit.

The fixed length cable EC discharged onto the conveyor 6 is delivered to the production unit 10 for twisted cable by two pairs of discharge hands 7 (ref. FIG. 4) annexed to the fixed length cable production unit 1.

The production unit 10 for twisted cable has a straightening unit 20 for carrying out straightening of the fixed length cable EC by taking delivery of a pair of wires forming a fixed length cable EC from the discharge hand 7 and drawing. The production unit 10 also includes a twisting unit 30 for twisting the fixed length cable EC drawn by the straightening unit 20 and a drive unit 60 for driving the twisting unit 30. Furthermore, as described later, the guides 12 are provided to accommodate the fixed length cables EC formed on the twisting lines by these units to guide the completed twisted cables to a discharge tray 11 (discharge station).

Referring to FIGS. 2 and 3, the straightening unit 20 has a bed 21 (fitting station) provided parallel to the conveyor 6 of the fixed length cable production unit 1, and a clamp 22 is provided on one end of the bed 21 for holding the fixed length cable EC. The straightening unit 20 also includes a fixed slide unit 23 for drawing the fixed length cable EC in cooperation with the clamp 22 by reciprocating along the lengthwise direction of the bed 21, and a delivery handling unit 25 for delivering the fixed length cable EC drawn by the slide unit 23 by reciprocating motion to the twisting unit 30 to be described later (with reference to FIG. 7).

Figure 5B:
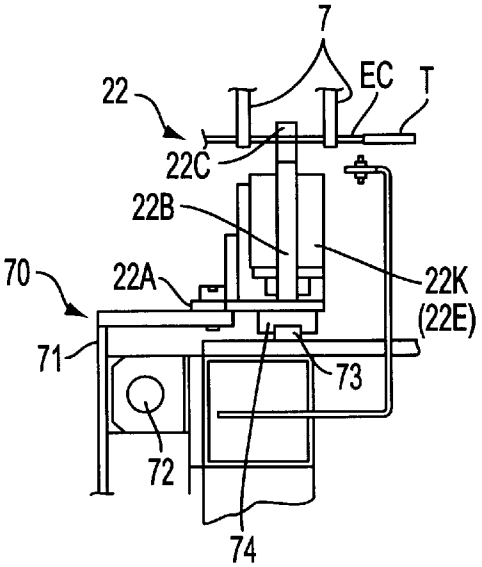
Figure 5A:
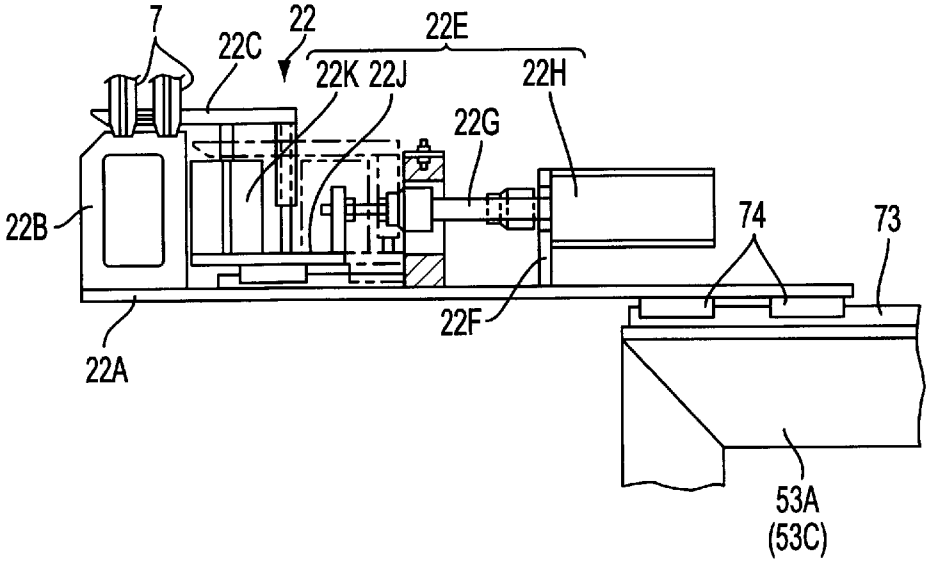

FIG. 4 is a perspective view showing the essential parts of the straightening unit 20. Also, FIGS. 5(A) and 5(B) are front and left side views, respectively, showing the clamp 22 of the straightening unit 20.

Referring to these views, the clamp 22 has a base plate 22A which extends in a direction transverse to the bed 21, an upright clamp stand 22B is provided on one end of the base plate 22A (side facing the one end of the bed 21), a clamp plate 22C for clamping the fixed length cable EC in cooperation with the clamp stand 22B, and a drive member 22E for driving the clamp plate 22C. The drive member 22E further includes a horizontal cylinder 22H which is fixed to the fixing plate 22F provided upright on the intermediate part of the base plate 22A for horizontally advancing and retracting the rod 22G. A movable plate 22J is carried on the rod 22G of the horizontal cylinder 22H, and a lift cylinder 22K is provided for moving the clamp plate 22C up and down. The clamp plate 22C is driven between a clamp position above the clamp stand 22B and the retracted position at the lateral side of the clamp stand 22B by the horizontal cylinder 22H. Then, by the lift cylinder 22K, the clamp plate 22C is displaced between the clamping position for clamping the fixed length cable EC on the clamp stand 22B by the clamp plate 22C and the released position for releasing the fixed length cable EC on the clamp stand 22B. The clamp plate 22C, when positioned at the retracted position, is located at the side and at a lowered position slightly lower than the upper surface of the clamp stand 22B, as seen in broken lines in FIG. 5(A).

On the other hand, the sliding unit 23 for drawing the fixed length cable EC in cooperation with the clamp 22 is provided with a slide base 23B for permitting movement in the forward movement direction for retraction from the clamp 22 along the longitudinal direction of the bed 21 and in the rearward movement direction for access to the clamp. A gear box 23C is provided upright on the slide base 23B, a pair of clamping rollers 23D is provided to extend substantially in parallel with one another in the direction transverse to the bed 21 when in the clamping position as seen in FIG. 4, and a guide 23E is fixed on one side and disposed between the two movable clamping rollers 23D, 23D.

The slide base 23B is configured in a manner to slide in both the forward movement direction and the rearward movement direction and is guided by the rail 23F positioned on the bed 21. In the illustrated example, the slide base 23B is constructed to be linked with the rail 23F via the linking part 23G provided on an extension transverse to the direction of the rail 23F, and is reciprocally movable by attaching the connecting part 23G to the outer periphery of an endless belt 23H of the conveyor unit 23A.

Figure 6:
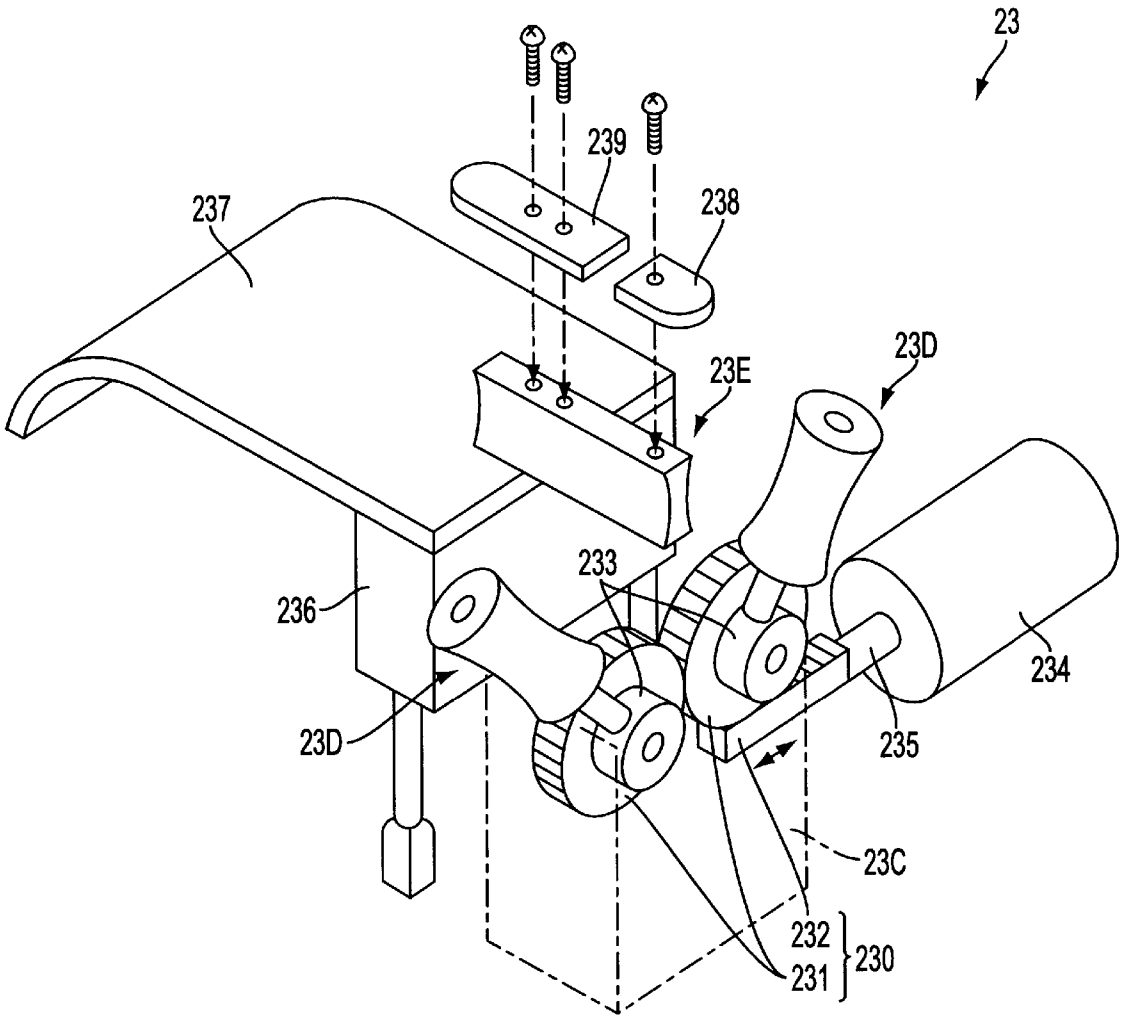
FIG. 6 is a partially disassembled perspective view showing an essential part of a slide unit.

FIG. 6 is a partially disassembled perspective view showing an essential part of the slide unit 23. Referring to the drawing, the gearbox 23C carries a gear unit 230 including a pair of gears 231, which are mutually geared, and a rack gear 232 geared to one of the gears 231, so that, by reciprocating the rack gear 232, the two gears 231, 231 are rotated simultaneously. A rotary moving member 233 is connected to each gear 231 in a manner to be rotated integrally therewith, with the rotary moving members being positioned outside of the gearbox 23C as seen in FIG. 4.

Each movable clamping roller 23D is rotatably mounted on a projection of each rotary member 233, and each clamping roller 23D is configured to have a substantially invented barrel shape, having a reduced diameter central anvil portion as clearly seen in FIG. 6. Thus, due to the rotation of the rotary members 233, the movable clamping rollers 23D can cooperate with the guide 23E, as described later, to clamp the fixed length cable EC. In the illustrated embodiment, each movable clamping roller 23D is freely rotatably carried on the projecting part of each rotary member 233, thereby making it possible to have rolling contact with the outer periphery of the fixed length cable EC.

Figure 8:
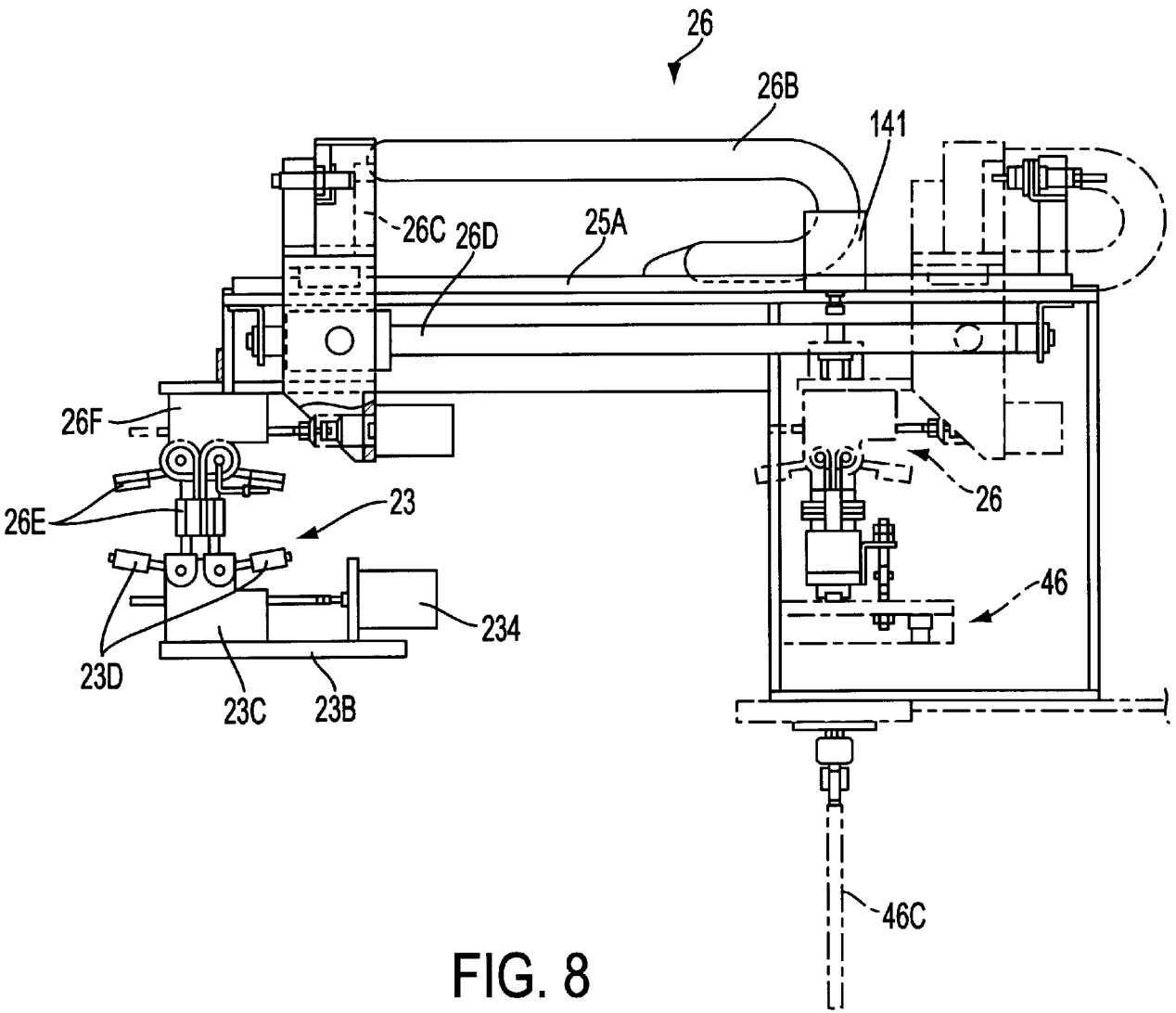
FIG. 8 is a front view of the delivery handling unit for the straightening unit in the production unit for twisted cable of FIG. 1.

As shown in FIG. 8, to the above-described slide base 23B there is fitted an air cylinder 234 at one side of the gear box 23C. The rod 235 of the air cylinder 234 is opposite the rack gear 232 of the slide unit 23 which has stopped at the end of the forward movement side, and the rod 235 of the air cylinder 234 is opposite the rack gear 232 of the slide unit 23 which stopped at the rearward movement side end. And, by reciprocating the rack gear 232, the movable clamping rollers 23D, 23D are rotated to permit displacement of the fixed length cable EC between the clamping position clamping the fixed length cable EC and the releasing position releasing the fixed length cable EC.

The guide 23E is fixed to the fixing stand 236, provided upright behind the gear box 23C, and extends between the two movable clamps 23D, 23D. Each lateral side of guide 23E is recessed in slightly curved manner, so as to allow the fixed length cable EC to run precisely along the side of the guide 23E.

In the illustrated example, on the top face of the fitting stand 236, there is fixed a guide plate 237 for guiding the A-end side of the fixed length cable EC (opposite side to the clamp 22), and the guide 23E is fixed to the top face of the guide plate 237.

On the top face of the guide 23E, a pair of the cover members 238, 239 are attached by screws to form a unit to prevent the fixed length cable EC from escaping upwardly. In the illustrated example, the cover members 238, 239 are fixed at spaced apart locations in the longitudinal direction of the guide 23E (in the direction extending along the longitudinal direction of the bed 21).

The guide 23E of the slide unit 23 is positioned between a pair of fixed length cables EC clamped at one end by the clamps 22, and clamped at the other end by the movable clamping rollers 23D, 23D. The conveyor unit 23A is driven to move the slide unit 23 forwardly, whereby a pair of fixed length cables EC can be drawn simultaneously. According to the illustrated embodiment, in consideration of the tension applied at the time of twisting the fixed length cable EC by the twisting unit 30, as described below, the drawn fixed length cable EC is to be delivered to the twisting unit 30 under a somewhat slack condition.

Referring next to FIGS. 2 and 3, the twisting unit 30 includes an A-end side unit 40 for clamping the A-end side of the fixed length cable EC and a B-end side unit 50 for clamping the B-end side. The fixed length cable EC is finished into a twisted wire by being twisted under the condition that each cable end part, corresponding to the two units 40, 50, is clamped.

First, in order to deliver the fixed length cable EC to the twisting unit 30 from the straightening unit 20, the straightening unit 20 described above is provided with a handling unit 25 for delivering the A-end of the fixed length cable EC to the A-end side unit 40, and on the other hand the B-end side unit 50 is provided with a slide unit 60 for sliding the clamp 22 so as to deliver the B-end of the fixed length cable EC to the B-end side unit 50.

Figure 7:
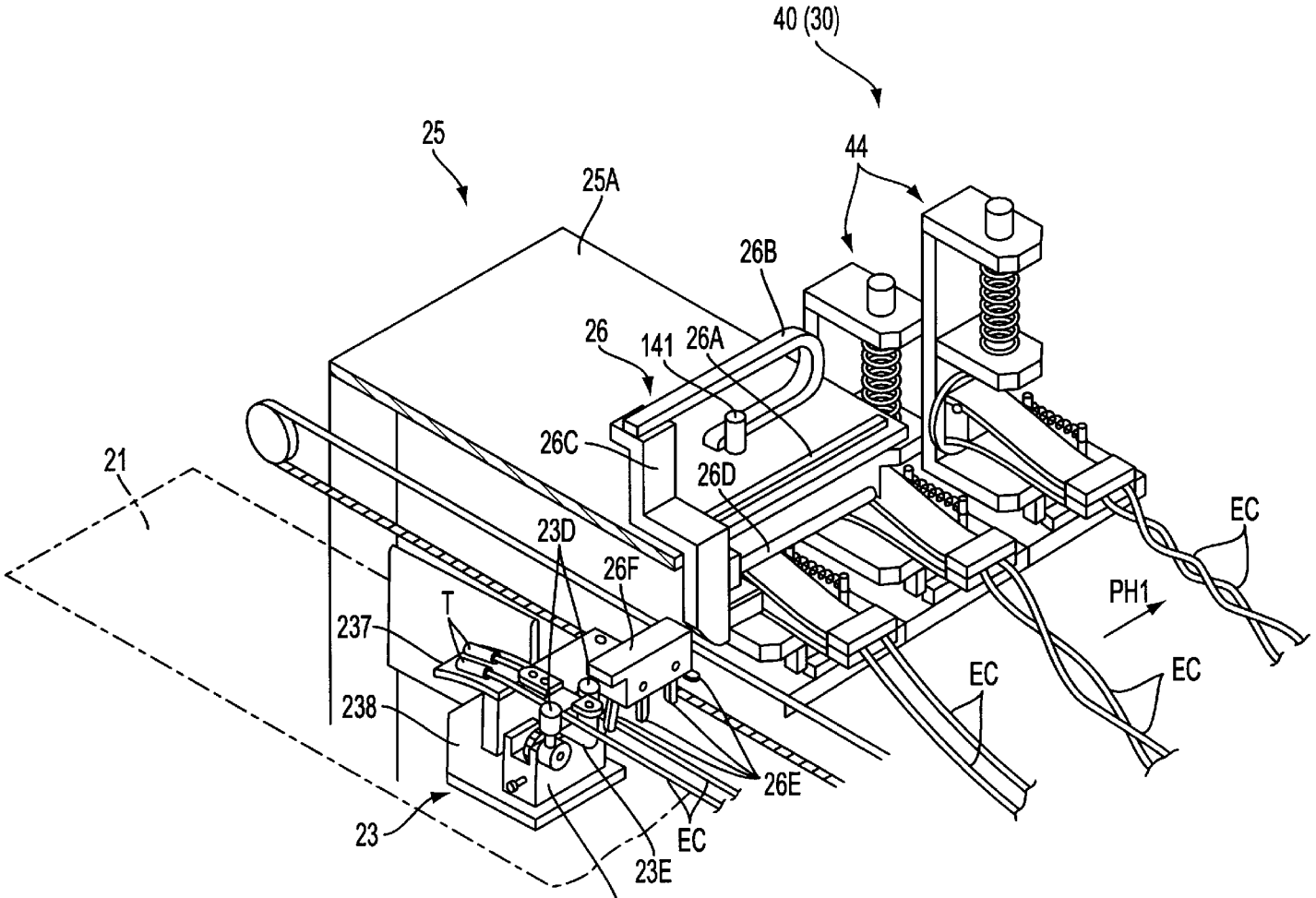
FIG. 7 is a perspective view of the delivery handling unit for the straightening unit in the production unit for twisted cable of FIG. 1.

FIG. 7 is a perspective view of the delivery handling unit 25 adapted for use within the straightening unit in the production unit for twisted cable of FIG. 1, and FIG. 8 is a front view of the delivery handling unit 25 adapted for use with the straightening unit in the production unit for twisted cable of FIG. 1.

Figure 27A:
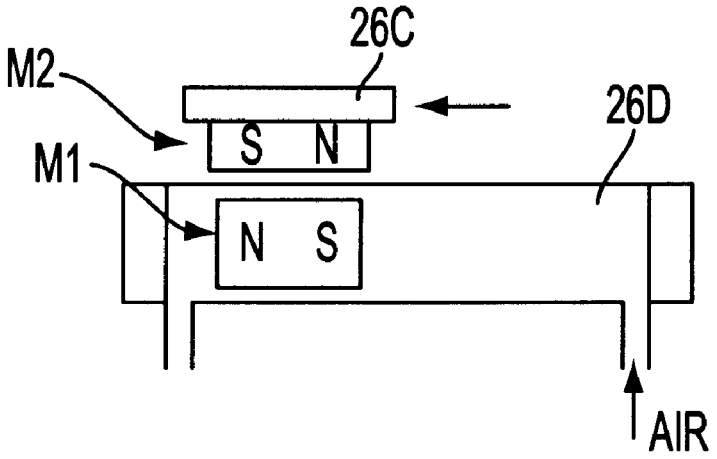
FIGS. 27(A) and 27(B) are schematic views depicting the operation of a magnetic type rodless cylinder utilized in the present invention.
Figure 27B:
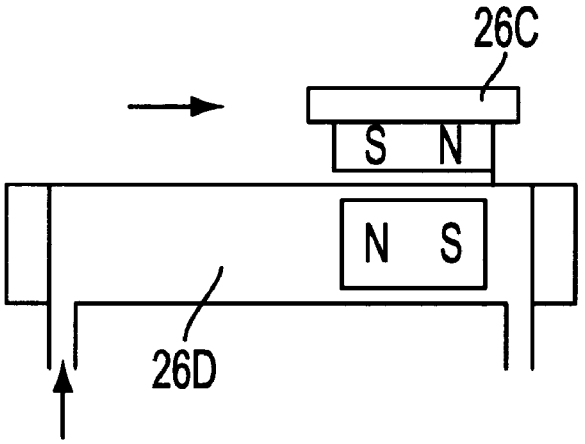

Referring to these figures, a set-up table 25A is additionally provided on the other end of the bed 21 (A-end side of the length adjusted cable EC). To this set-up table 25A there is provided a carrying robot 26 which reciprocates in a direction transverse to the bed 21. The carrying robot 26 includes a rail 26A which extends in the transverse direction (direction transverse to the bed 21) of the above set-up table 25A. A moving member 26C which is connected with the cable bearing 26B provided on the set-up table 25A, and a magnetic type rodless cylinder 26D is provided below the set-up table 25A for driving the moving member 26C in the lengthwise direction. A schematic example of a magnetic type rodless cylinder 26D is depicted in FIGS. 27(A) and 27(B). A first magnet M1 is reciprocably movable within a cylinder from one end thereof to the other by application of air pressure alternatively to either cylinder end. Movement of magnet M1 causes a resulting movement of a magnet M2 affixed to the moving member 26C. Further, the moving member 26C carries a handling unit 26F which has two pairs of cable hands 26E. And, in the event that the moving member 26C is in the home position on the bed 21 side (the position shown in solid line in FIG. 8), the handling unit 26F is disposed above the slide unit 23 which has moved forward on the bed 21, and the part near the A-end of the fixed length cable EC is allowed to be clamped with the two pairs of the cable hands 26E. In the event of forward movement from the above home position toward the twisting unit 30 side (the position shown by the imaginary line in FIG. 8), the A-end part of each fixed length cable EC clamped by the cable hands 26E can be delivered to the A-end side unit 40 of the twisting unit 30.

On the other hand, in order to deliver the B-end part of the fixed length cable EC to the B-end side unit 50 of the twisting unit 30, the clamp 22 described above is connected to the slide unit 70.

Figure 9:
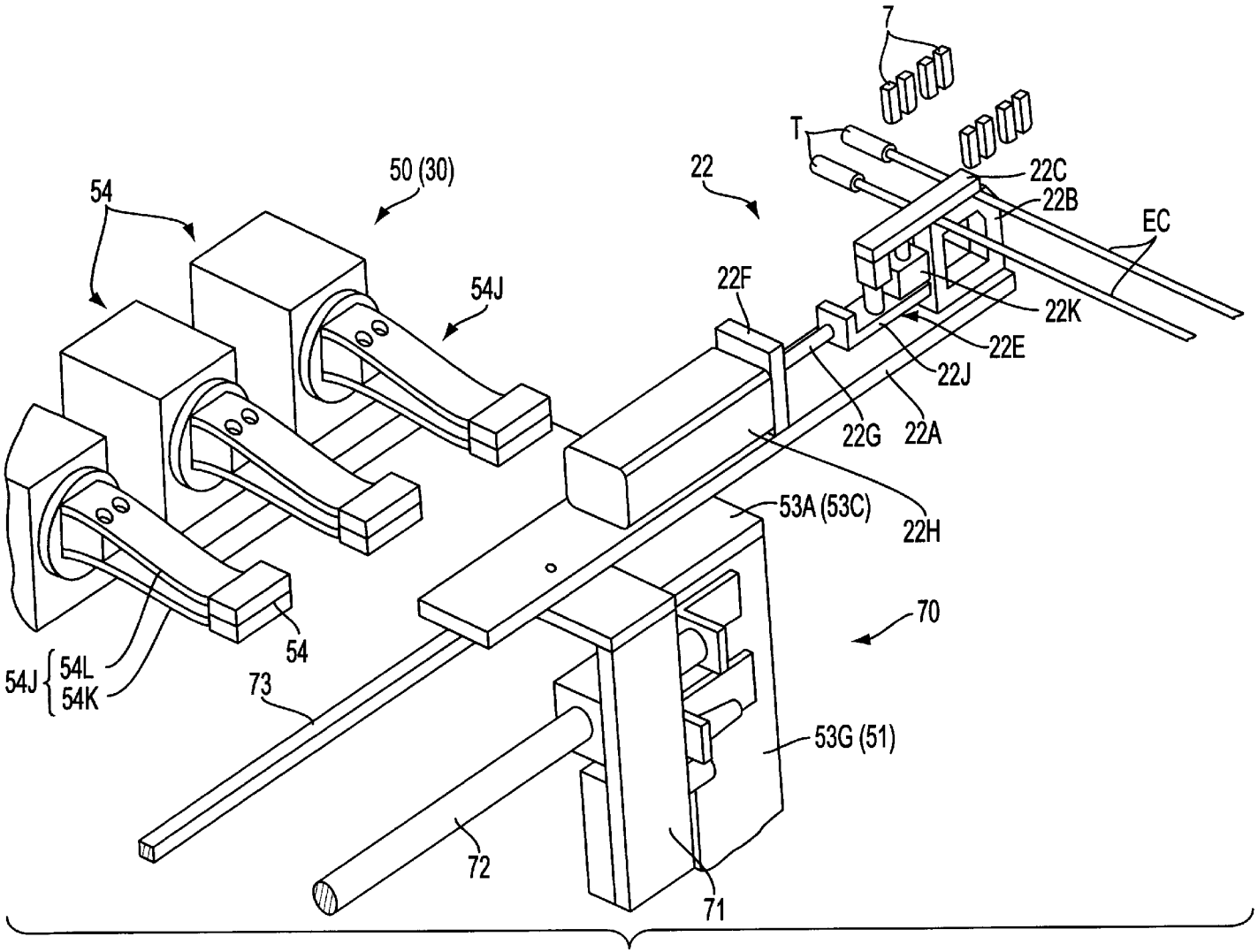
FIG. 9 is a perspective view of the slide unit adopted in the production unit for twisted cable of FIG. 1.
Figure 10:
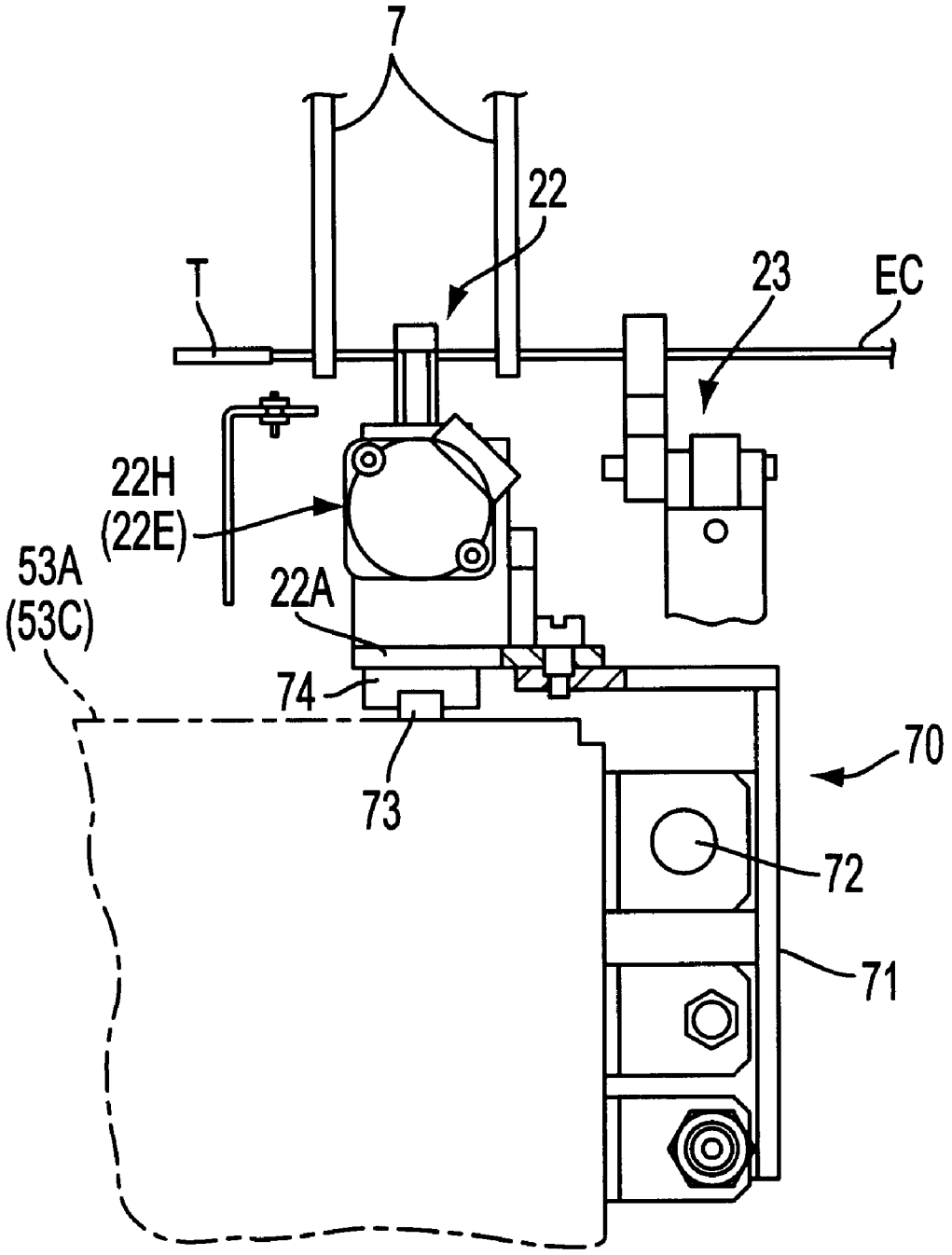
FIG. 10 is a side view of the slide unit of the production unit for twisted cable of FIG. 1.

FIG. 9 is a perspective view of the slide unit 70 of the production unit for twisted cable of FIG. 1, and FIG. 10 is a side view of the slide unit 70 of the production unit for twisted cable of FIG. 1.

As shown in these figures, the slide unit 70 includes a carrier plate 71 which carries the base plate 22A of the clamp 22, and a magnetic type rodless cylinder 72 for connecting the carrier plate to the rack 51 of the B-end side unit 50, to be described later, to reciprocate in the transverse direction of the bed 21. A rail 73 is positioned on the upper surface of the rack 51, and a slide bearing unit 74 (as seen in FIGS. 5(A) and 5(B) and in FIG. 10) having rolling contact with the rail 73 is fitted to the lower surface of the base plate 22A so that the base plate 22A is allowed to reciprocate. By this provision, the clamp 22 on a base plate 22A can receive the B-end of the fixed length cable EC from the discharge hand 7 of the production unit for fixed length cable, and when it moves forward from the home position to displace to the twisting unit 30 side (note FIG. 16, to be described later), it becomes possible to deliver the clamped B-end of the fixed length cable EC to the B-end side unit 50 of the twisting unit 30.

Next, referring to FIGS. 2, 3, 7, 11 and thereafter, the twisting unit 30 is described in detail.

First, referring to FIGS. 2 and 3, the twisting unit 30 is formed by the A-end side unit 40 and B-end side unit 50 disposed at opposite ends to each other along the longitudinal direction of the bed 21. The A-end side unit 40 is formed in a rectangular configuration which extends in the opposite direction to the B-end side unit 50 in plan view, and on its lower part there is provided a ball screw unit 41 which extends in the longitudinal direction of the A-end side unit 40. This ball screw unit 41 is configured to reciprocally move the movable rack 43 connected by said ball screw unit 41 by being rotatably driven in opposite directions by the reversible motor 42.

The movable rack 43 is provided with a plurality of cable clamps 44. By adjustment of the distance between the A-end side unit 40 and the B-end side unit 50 by the ball screw unit 41, the A-ends of fixed length cables EC of different lengths can be clamped by the cable clamps 44.

Figure 11:
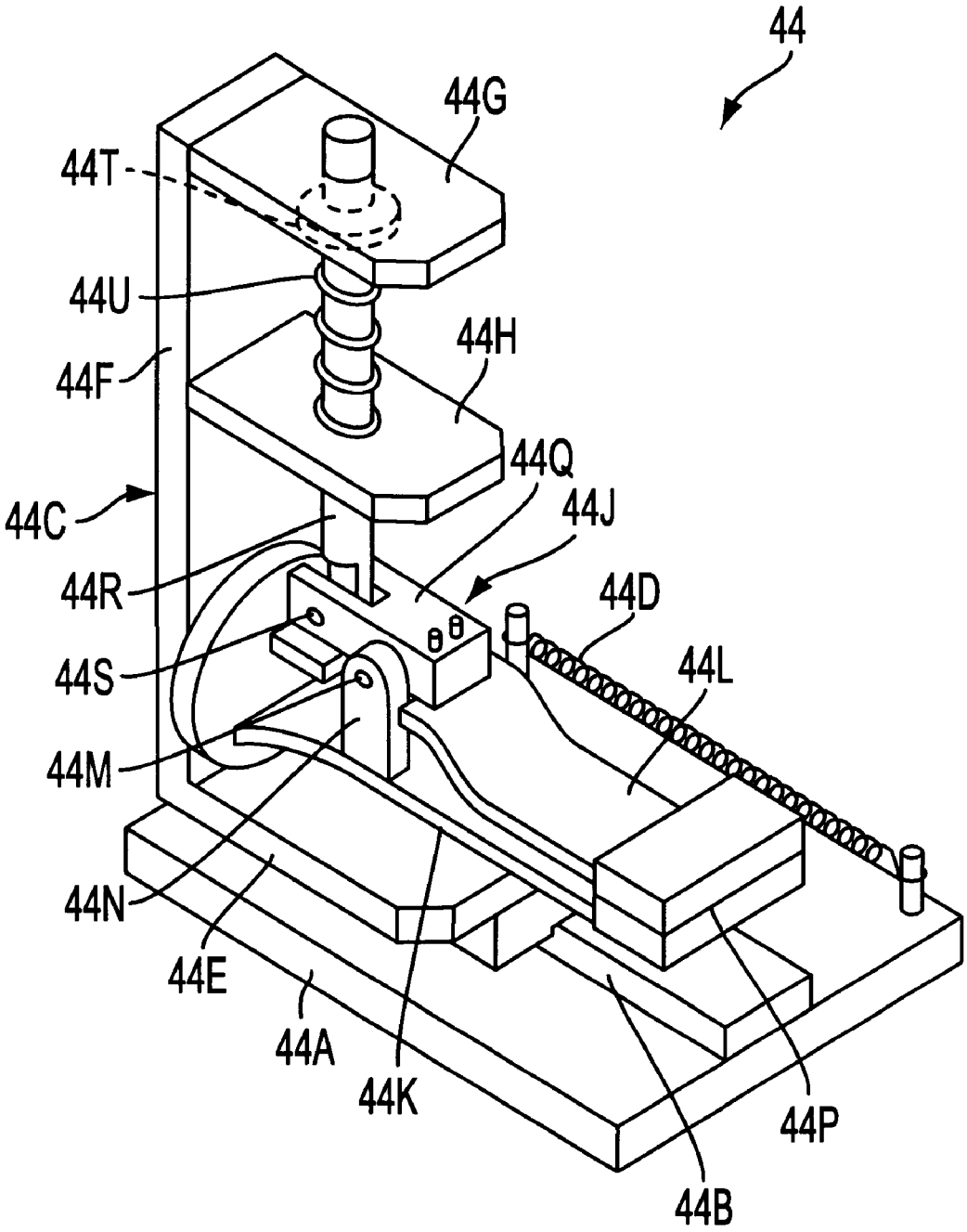
FIG. 11 is a perspective view of a cable clamp of the production unit for twisted cable of FIG. 1.
Figure 12:
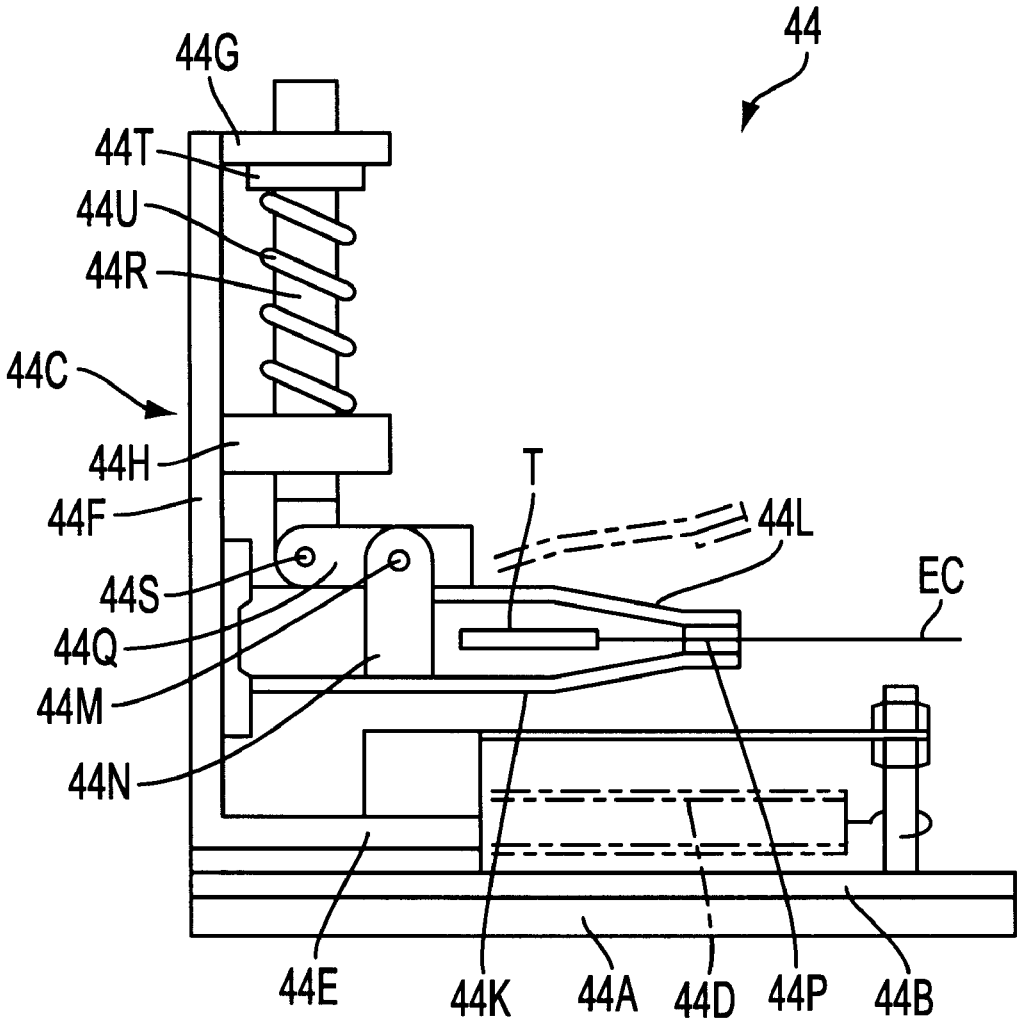
FIG. 12 is a side view of the cable clamp in the production unit for twisted cable of FIG. 1.

FIG. 11 shows a perspective view of the cable clamp 44 for the production unit for twisted cable of FIG. 1, and FIG. 12 is a side view of the cable clamp 44 for the production means for twisted cable of FIG. 1.

Referring to these figures, the cable clamp 44 on the A-end side includes a base plate 44A, a rail 44B provided on the base plate 44A, and a body frame 44C carried on the rail 44B in a sliding manner. The base plate 44A is a metal member of approximately rectangular shape in plan view. In the illustrated embodiment, the base plate 44A and the body frame 44C are connected by the extension spring 44D, by which the body frame 44C is biased toward the B-end side along the rail 44B.

The rail 44B extends along the longitudinal direction of the fixed length cable EC to be provided with twisting, so that the tension of the length adjusted cable EC can be absorbed during twisting processing by allowing the body frame 44C to slide in the longitudinal direction.

The body frame 44C is a metal member having an integral base part 44E, a back plate 44F formed at the end of the base part 44E, a top plate 44G provided in a hood shape at the top of the back plate 44F, and an intermediate plate 44H opposed to the top plate 44G and formed approximately at the mid-point of the back plate 44F and parallel with the top plate 44G. A clamp unit 44J is provided between the intermediate plate 44H and the base plate 44E of the back plate 44F.

The clamp unit 44J includes a fixed side plate 44K which is fixed in cantilever form to the back plate 44F, a movable side plate 44L disposed above the fixed side plate 44K, and a hinge 44N for pivotably mounting the movable side plate 44L relative to the fixed side plate 44K through the pin 44M. On each of the free end sides of the plates 44K and 44L (opposite of the back plate 44F) there is provided a nip 44P for clamping the fixed length cable EC.

A rod 44R is connected to the movable side plate through a link member 44Q. The rod 44R extends vertically and through the top plate 44G and intermediate plate 44H, and the lower end of the rod is connected with link 44Q by pin 44S, which link is connected by the pin 44M to the hinge 44N. Further, a flange 44T is connected to an intermediate part of the rod 44R, the flange 44T contacts the lower surface of the top plate 44G, and a compression coil spring 44U is provided between the flange 44T and the intermediate plate 44H. Thus, clamp unit 44J is so constructed that, as the rod 44R is forced upward by the compression coil spring 44U, the plate 44L on the movable side is forced in the clockwise direction around the pin 44M by the spring force to close the nip 44P, and when the rod 44R is depressed, the plate 44L rotates in the counter-clockwise direction around the pin 44M to open the nip 44P.

Figure 13:
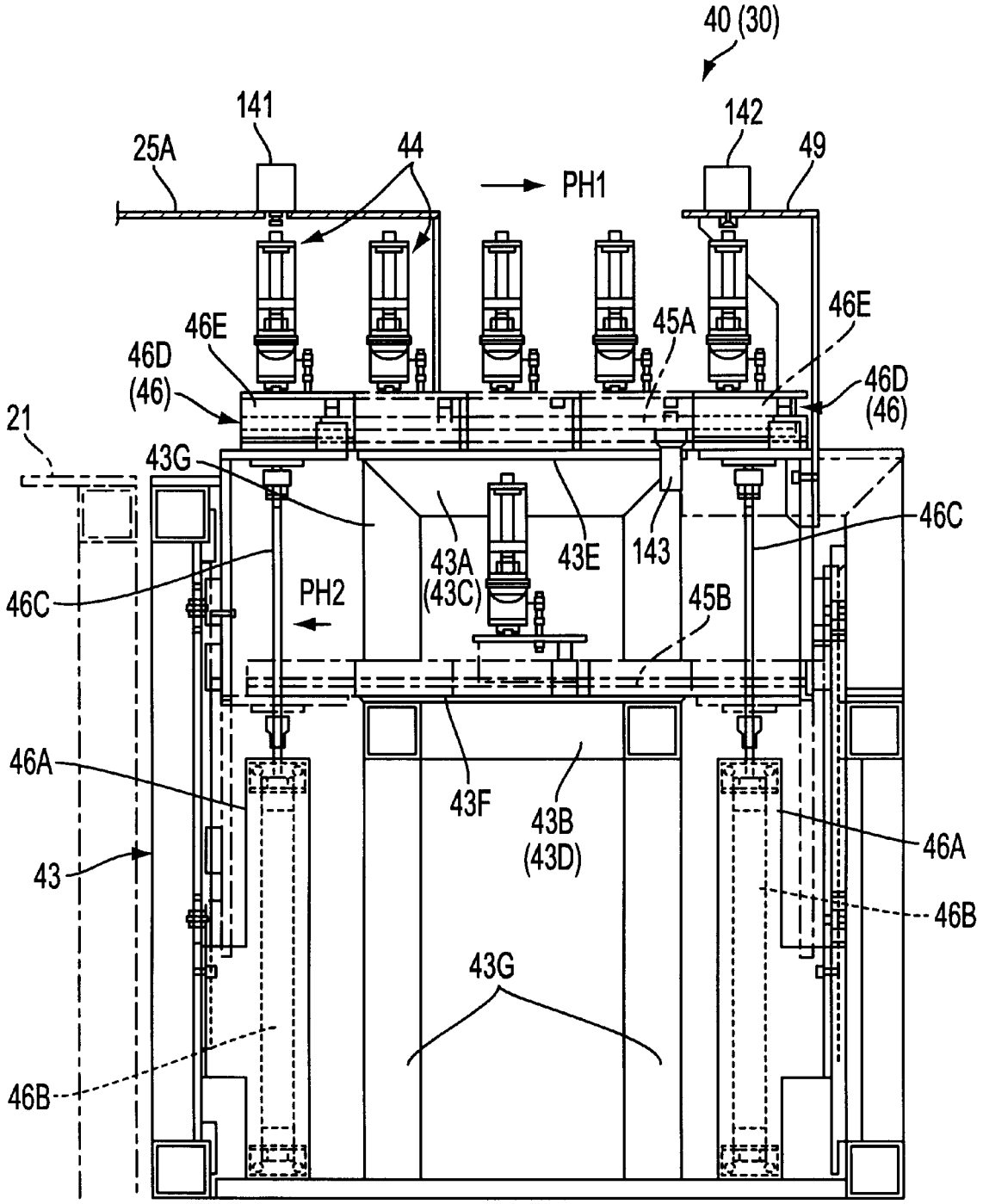
FIG. 13 is a front elevation of the movable rack of the production unit for twisted cable of FIG. 1.
Figure 14:
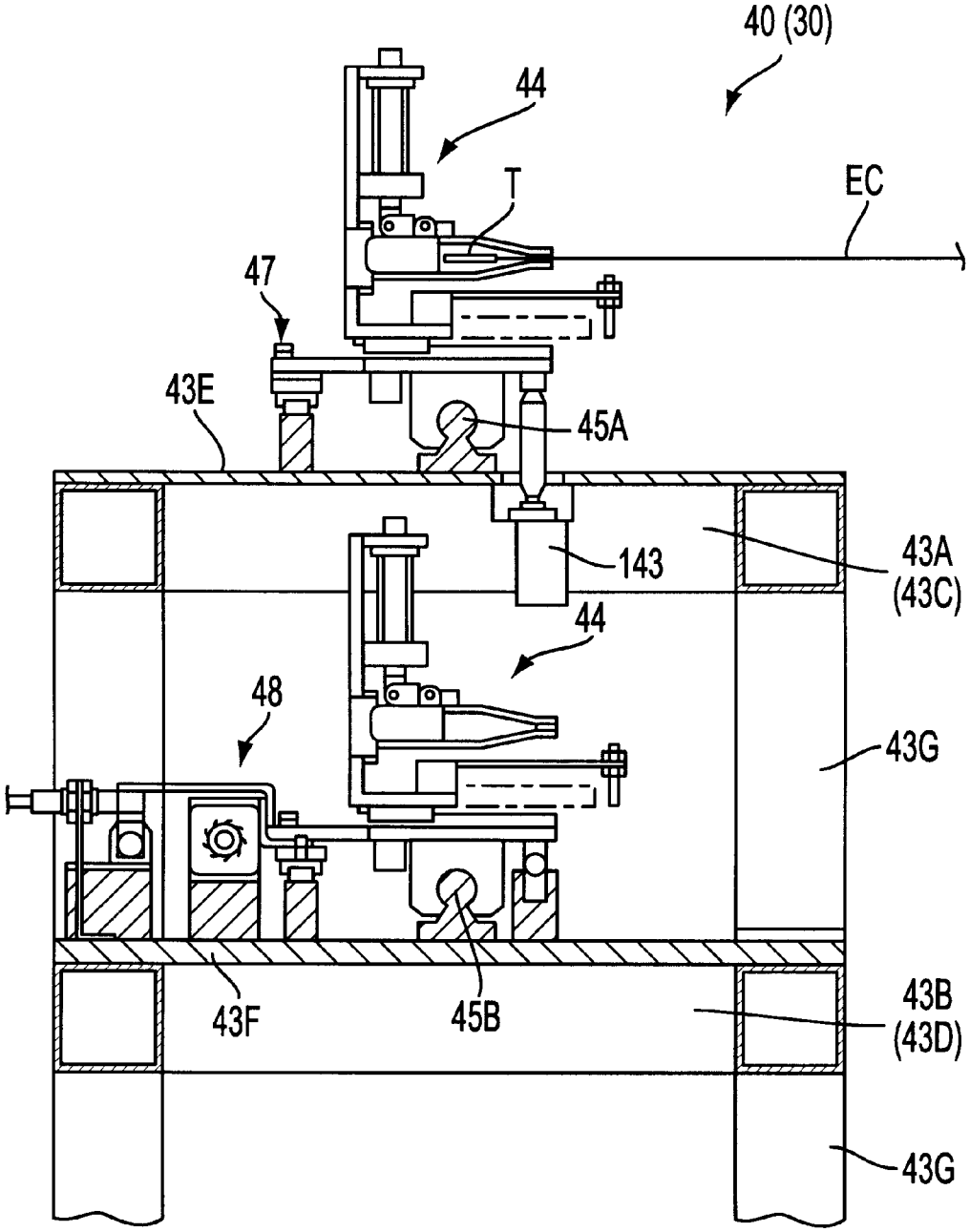
FIG. 14 is a sectional view of the movable rack of the production unit for twisted cable of FIG. 1.
Figure 15:
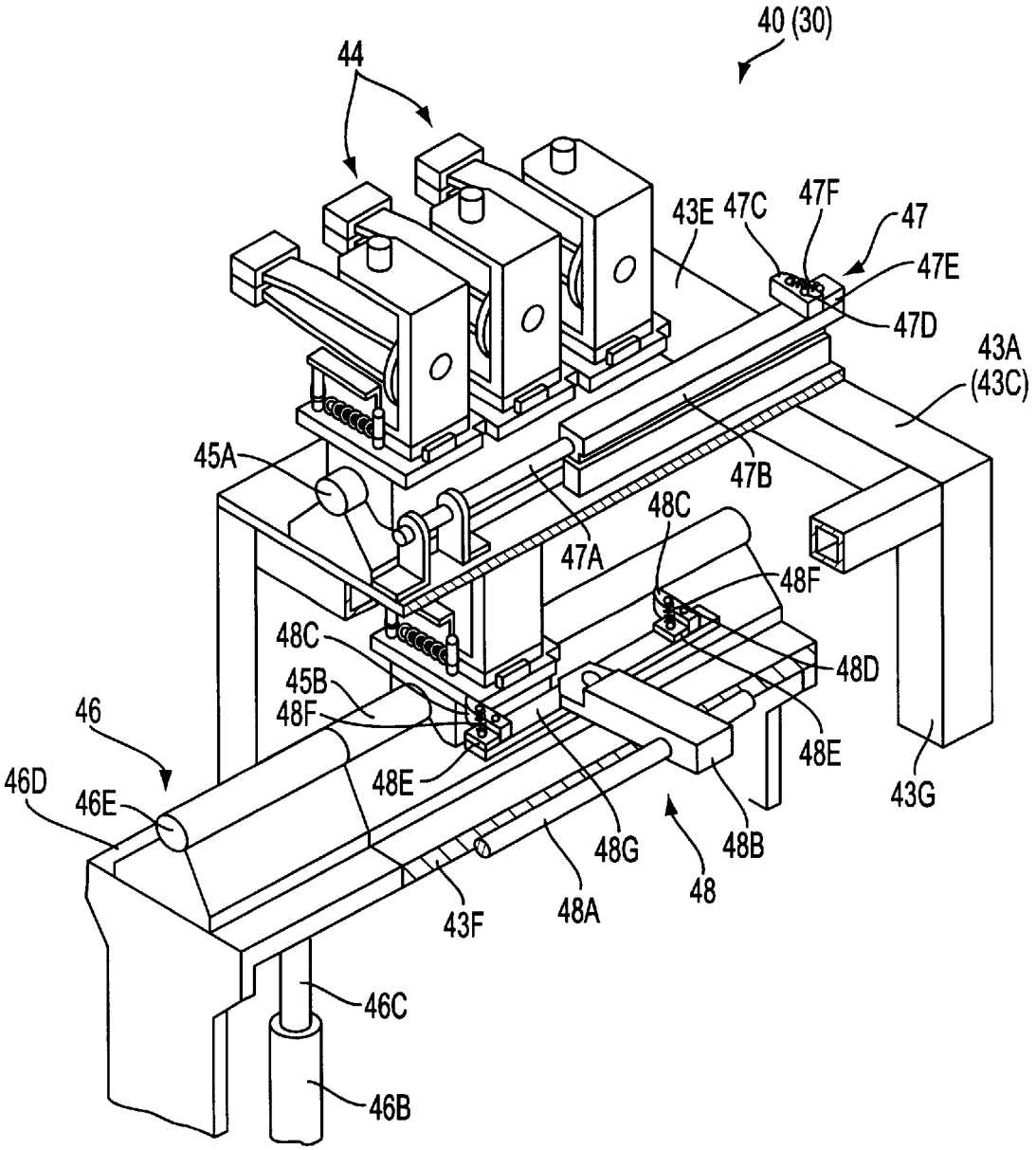
FIG. 15 is a perspective view of the back side of the movable rack of the production unit for twisted cable of FIG. 1.

FIG. 13 is a front elevation view of the movable rack 43 in the production unit for twisted cable of FIG. 1, FIG. 14 is a sectional view of the movable rack 43 in the production unit for twisted cable of FIG. 1, and FIG. 15 is a perspective view of the back side of the movable rack 43 in the production unit for twisted cable of FIG. 1.

Referring to these figures, the movable rack 43 carrying the cable clamp 44 constitutes a frame structure having two stages, an upper stage 43A and a lower stage 43B. The upper stage 43A provides a forward movement route PH1 to facilitate horizontal movement of the cable clamp 44 forwardly along the transverse direction of the bed 21. Conversely, the lower stage part 43B provides the rearward movement route PH2 for moving the cable clamp rearwardly. Each of the stages 43A, 43B includes fixed top plates 43E, 43F, respectively by providing the frames 43C, 43D, which may be configured to have a channel-shape in cross-section, to fix the top plates 43E, 43F, respectively, and by connecting the two with the stay 43G, the two routes PH1 and PH2 are endlessly connectable.

Each of the routes PH1 and PH2 includes respective guide rails 45A and 45B to guide the slides fixed to the lower face of the base plate 44A of cable clamps 44. The clamps are movable in parallel along the guide rails 45A, 45B in the direction of advance of each route PH1, PH2.

In order to circulate the cable clamps 44 between the upper stage 43A and the lower stage 43B, a pair of lifts 46 are provided on opposite sides of the two stages 43A and 43B, as clearly seen in FIG. 13. Each lift 46 includes an air or hydraulic cylinder 46B, which is fixed to the movable rack 43 through the fitting plate 46A and extends vertically, and a carrier 46D which moves vertically to a raised position continuous with the upper stage 43A and to a descending position continuous with the lower stage 43B. By providing the carrier 46D with a rail 46E continuous to the guide rail 45A and 45B, respectively, of each of the stages 43A, 43B and moving the carrier which carries the cable clamp 44 on the rail 46E up and down, the cable clamp 44 is made transferable from one stage 43A(43B) to the other stage 43B (43A).

As shown in FIG. 15, in order to have the cable clamp 44 slide on each of the stages 43A, 43B, the movable rack 43 is provided with the moving units 47, 48. Each of the moving units 47, 48 is disposed on the back side (opposite side to the B-end side) of the guide rails 45A, 45B, and is provided with the magnetic type rodless cylinder 47A, 48A mounted in parallel with the guide rails 45A, 45B. The sliders 47B, 48B to be moved in reciprocation by the above rodless cylinders 47A, 48A.

The slider 47B of the upper stage 43A is a metal member of rectangular cross section extending along the longitudinal direction of the guide rail 45A, and is provided with a stopping claw 47C on the upstream side of the forward movement direction. The stopping claw 47C is cantilevered and intermittently rotatable by the pivot pin 47D. A stop 47E is fixed adjacent claw 47C on the upstream side in the forward movement direction. The stopping claw 47C is allowed to rotate only in the counter-clockwise direction from the illustrated position, and is biased toward the stop 47E by the tension spring 47F provided on the stop 47E. And, when the rodless cylinder 47A causes the slider 47B to move forward at a timing to be described later, the stopping claw 47C is engaged with the base plate 44A of the cable clamp 44 at the upstream position (on the lift 46 on the upstream side in the forward movement direction), so that displacement by one part can be made toward the downstream side. As a result, the cable clamp 44 on the downstream side is displaced integrally to place the cable clamp, on the most downstream side, on the lift on the downstream side in the forward movement direction.

On the other hand, the slider 48B on the lower stage 43B is carried in an approximately cantilever style by the rodless cylinder 48A and is generally perpendicular to the rodless cylinder 48A. The central part of a drive rod 48G, lying parallel with the guide rail 45B, is connected to the free end of the slider 48B. A pair of stopping claws 48C are mounted on opposite ends of the drive rod 48G, intermittently in a rotatable manner and in approximately cantilever style, by the pivot pin 48D. A stop 48E is fixed adjacent each stopping claw 48C on the upstream side in the direction of rearward movement. Thus, the stopping claw 48C is allowed to rotate only in the clockwise direction from the illustrated position, and is biased toward the stop 48E side by the tension spring 48F provided on the stop 48E. And, when the rodless cylinder 48A causes forward movement of the slider 48B, at a timing to be described later, the stopping claw 48C engages the base plate 44A of the cable clamp 44 lying on the lift 46 on the upstream side in the rearward movement direction to return to the downstream side. As a result, the cable clamp 44 on the lift 46 on the upstream side in the rearward movement direction returns to the lift 46 on the upstream side in the forward movement direction.

Referring to FIG. 13, in order to control opening and closing of the cable clamp 44, the set-up table 25A and the fitting stand 49 provided on the upper end of the downstream side in the forward movement direction are respectively provided with air cylinders 141, 142. With the air cylinder 141 of the set-up table 25A, delivery from the handling unit 25 of the fixed length cable EC is carried out, and with the air cylinder 142 of the fitting stand 49, the fixed length cable EC formed into the twisted cable is discharged into the discharge tray 11.

Next, the B-end side unit 50 will be explained with reference to FIGS. 16–20.

Figure 16:
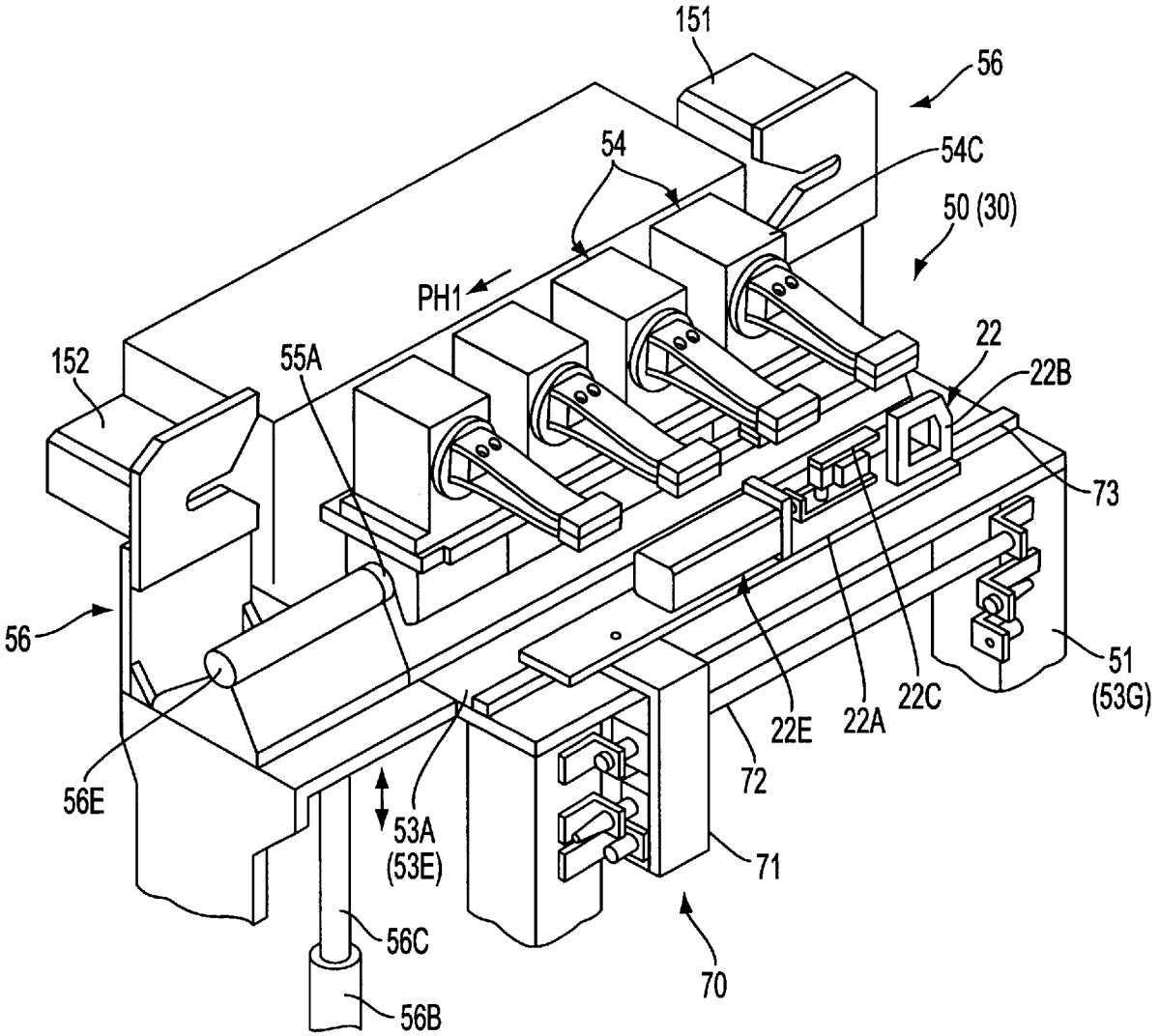
FIG. 16 is a perspective view of the B-end side unit of the production unit for twisted cable of FIG. 1.
Figure 17:
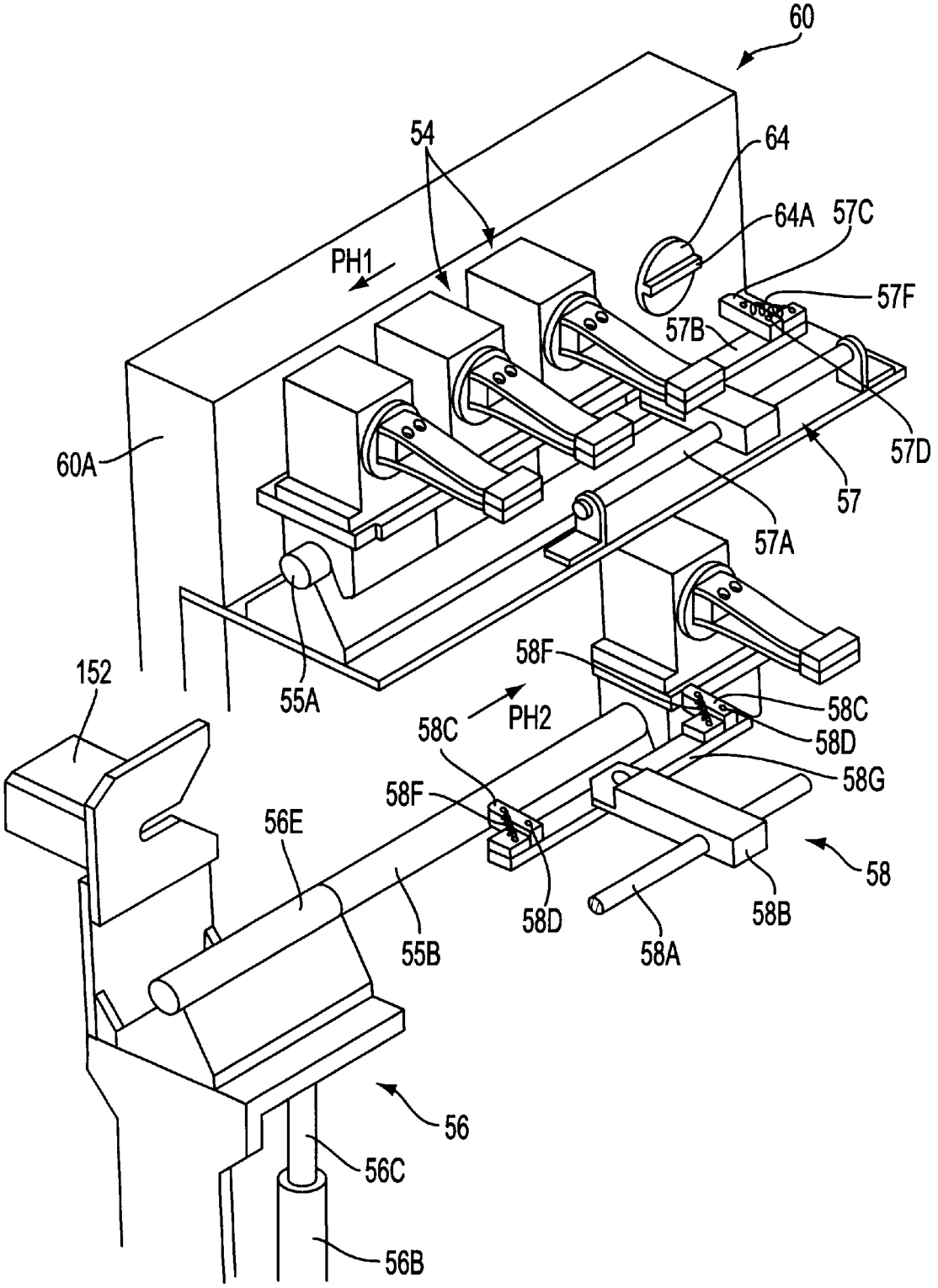
FIG. 17 is a perspective view of the B-end side unit of the production unit for twisted cable of FIG. 1 in another position.
Figure 18:
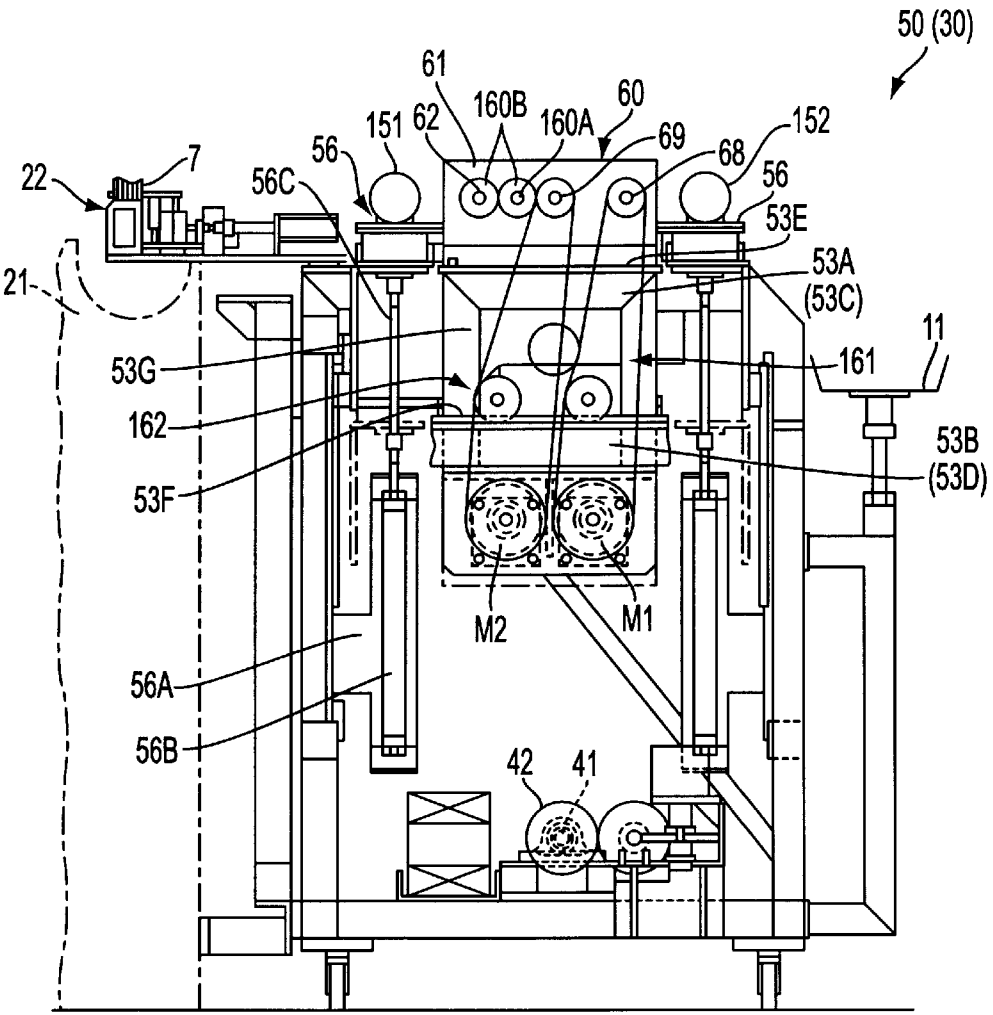
FIG. 18 is a rear elevation of the B-end side unit of the production unit for twisted cable of FIG. 1.

FIGS. 16 and 17 are perspective views of the B-end side unit in the production unit for twisted cable of FIG. 1, and FIG. 18 is a rear elevation of the B-end side unit in the production unit for twisted cable of FIG. 1. Referring to these figures, the B-end side unit 50 has a rack 51 forming a frame structure having two stages, an upper stage 53A and a lower stage 53B. The upper stage 53A forms a forward movement route PH1 by the rail 55A extending transverse to the direction of the bed 21, and on the other hand, the lower stage 53B forms a rearward movement route PH2 by the rail 55B. Also, the unit is furnished with a pair of lifts 56 disposed on opposite ends of the two routes PH1, PH2.

The rack 51 forms a frame structure having upper and lower stages. The upper stage 53A forms a forward movement route PH1 to facilitate horizontal movement of the cable clamp 54 along a direction transverse to the bed 21, and conversely, the lower stage part 53B provides the rearward movement route PH2 for moving the cable clamp 54 rearwardly. Each of the stages 53A, 53B fixes the top plates 53E, 53F, respectively by providing the frames 53C, 53D, which may be configured to have a channel-shape in cross-section, to fix the top plates 53E, 53F, respectively, and by connecting the two with the stay 53G, the two routes PH1 and PH2 are formed in endlessly connectable shapes.

Figure 19:
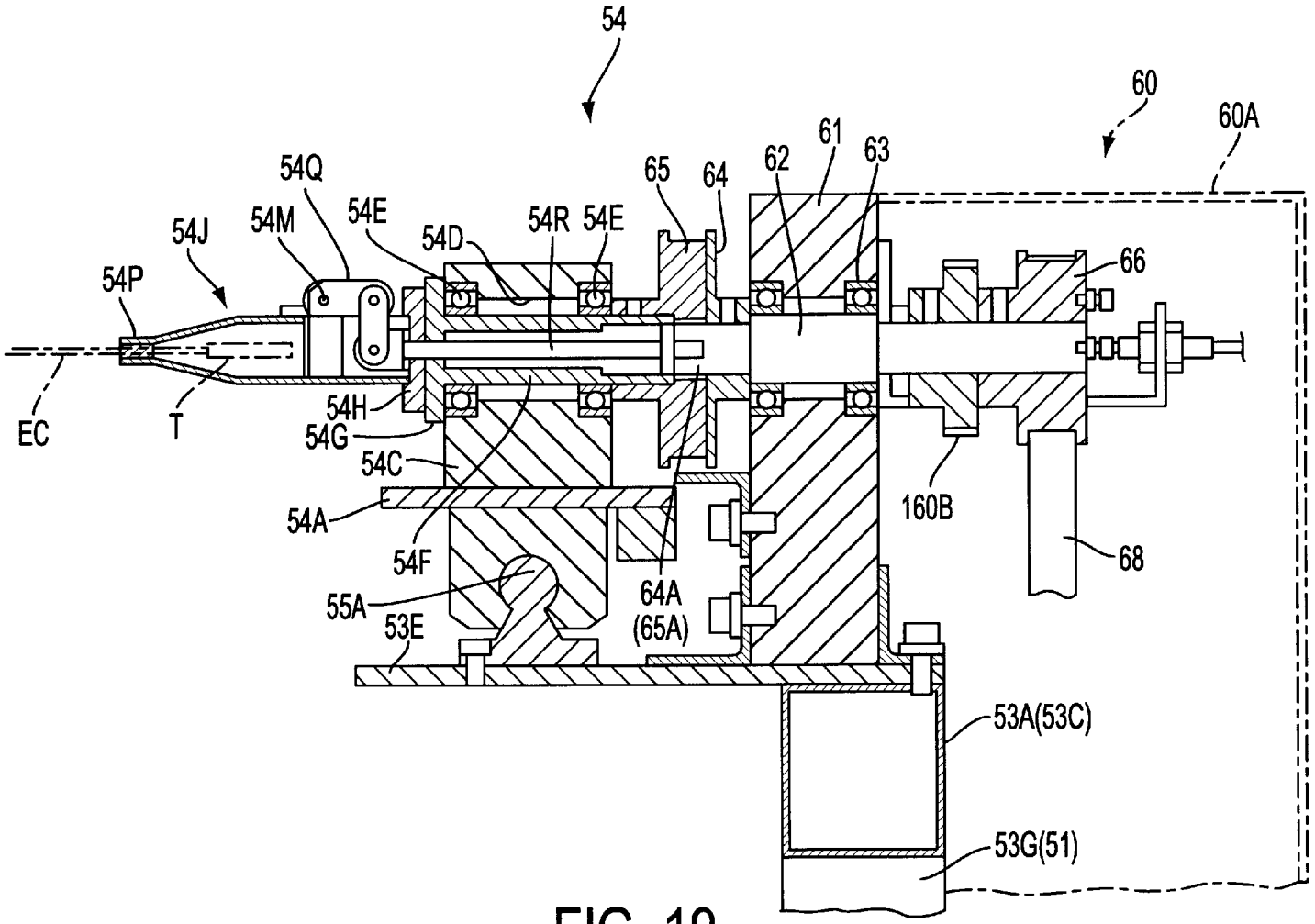
FIG. 19 is a sectional view of the B-end side unit of the production unit for twisted cable of FIG. 1.

Each of the routes PH1 and PH2 includes the guide rails 55A and 55B to guide the slides fixed to the lower face of the base plate 54A of cable clamp 54 as seen in FIG. 19. The slides are movable in parallel along the guide rails 55A, 55B in the direction of advance of each route PH1, PH2.

Figure 20:
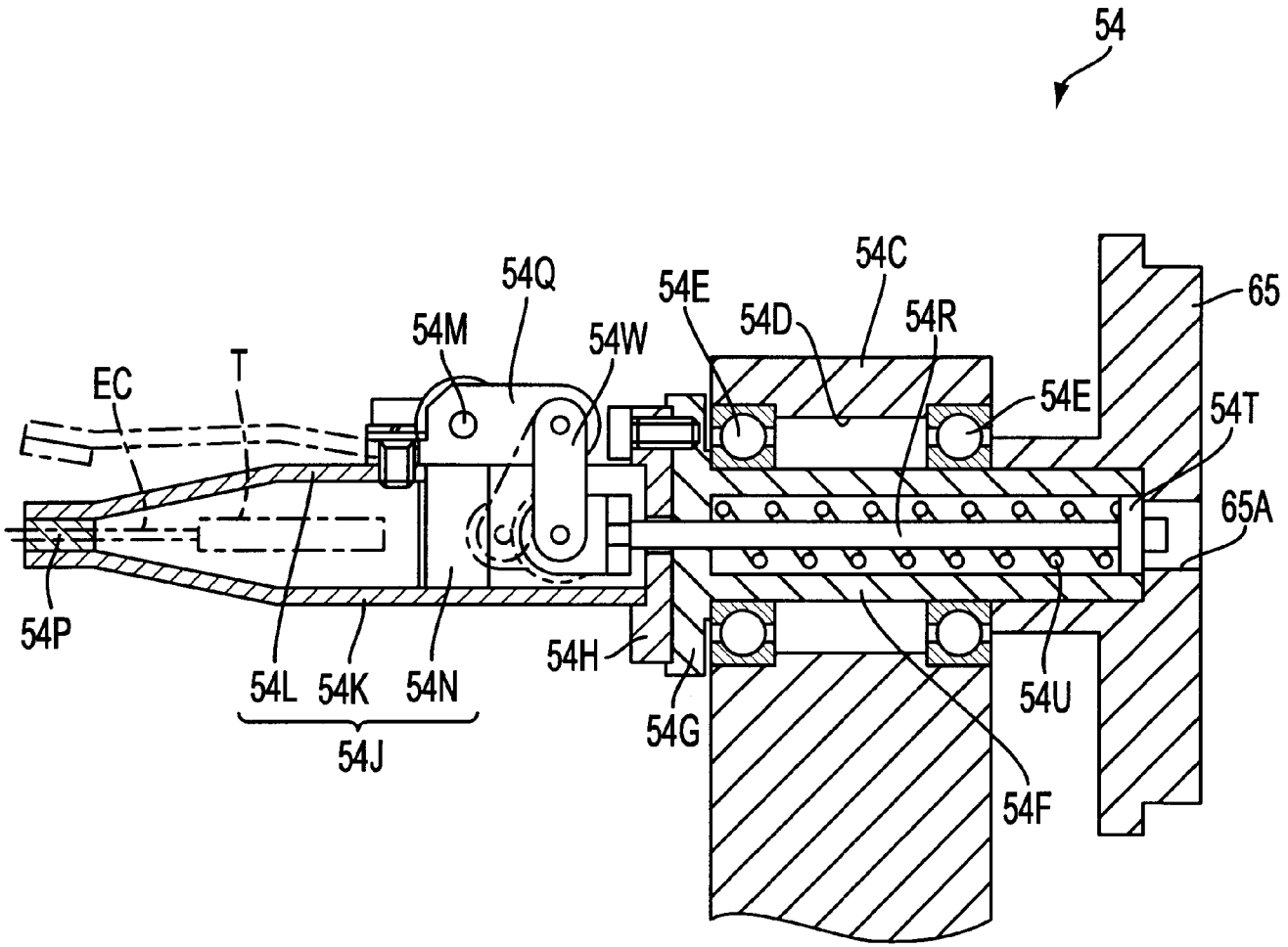
FIG. 20 is an enlarged sectional view of the B-end side unit shown in FIG. 19.

FIG. 19 is a sectional view of the B-end side unit in the production unit for twisted cable of FIG. 1, and FIG. 20 is an enlarged view of FIG. 19. Referring to these figures, the cable clamp 54 on the B-end side includes a base plate 54A and a body block 54C fixed to the base plate 54A.

The body block 54C includes a through hole 54D penetrating in the opposite direction to the A-end side block 40. To this through hole 54D there is fitted a rotary sleeve 54F through a pair of bearings 54E.

The rotary sleeve 54F has an integral flange 54G facing the A-end side carrying the clamp unit 54J through the fitting plate 54H which is fastened to the flange 54G by screws as shown in FIG. 20.

The clamp unit 54J has a fixed side plate 54K which is fixed in a cantilever manner to the fitting plate 54H, a movable side plate 54L which is disposed in opposition to the fixed side plate 54K around a center of rotation of the flange 54G, and a hinge 54N pivotally mounts the movable side plate 54L to the fixed side plate 54K through a pin 54M. The free ends of the plates 54K, 54L (opposite to the flange 54F) are provided with nip parts 54P which clamp the fixed length cable EC.

Further, a rod 54R is connected to the movable side plate 54L through a link member 54Q. The rod 54R is disposed concentrically in the rotary sleeve 54F with one end extending horizontally and linked with the link member 54Q via link 54W, and the other end protrudes slightly from the rotary sleeve. Furthermore, a flange part 54T which is in sliding contact with the inner periphery of the rotary sleeve 54F is integrally formed with an intermediate part of the rod 54R. On the other hand, a compression coil spring 54U is provided between the flange part 54T and the flange 54G of the rotary sleeve 54F. By this construction, because the rod 54R receives the biasing force of the compression coil spring 54U toward the right side of the drawing, the movable side plate 54L is biased in the counter-clockwise direction around the pin 54M to keep the nip 54P closed. By depressing the free end of the rod 54R, via one of the cylinders 151, 152, the plate 54L rotates clockwise around the pin 54M to open the nip 54P, as shown in broken lines in FIG. 20.

The pair of lifts 56 include an air or hydraulic cylinder 56B which is fixed to the movable rack 53 through the fitting plate 56A and extends vertically, and a carrier 56D which is moved up and down to the rising position continuous with the upper stage 53A and to the descending position continuous with the lower stage 53B. By providing the carrier 56D with the rails 56E continuous with the guide rails 55A of each stage 53A, 53B and lifting is performed with the cable clamp 54 carried on the rails 56E, the cable clamp 54 can be delivered from one stage 53A (53B) to the other stage 53B (53A).

Figure 26:
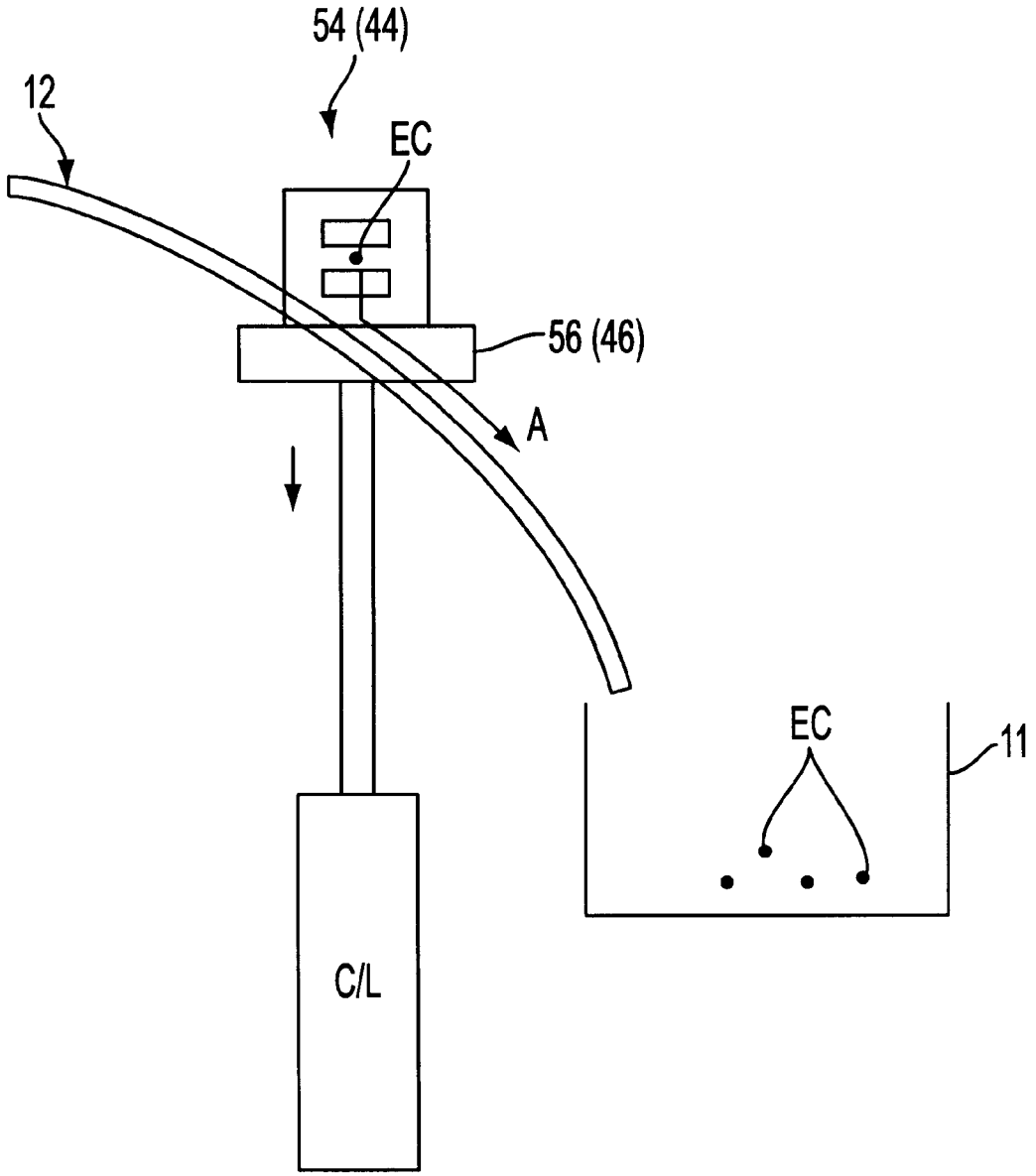
FIG. 26 is a schematic view depicting the discharge of the fixed length cable onto the guides for passage into the discharge tray.

Each lift 56 is provided with air or hydraulic cylinders 151, 152 for controlling the opening and closing of the cable clamp 54. And, by the cylinder 151 provided on the lift 56 on the upstream side of the forward movement direction PH1, delivery of the fixed length cable EC from the clamp 22 is made, and by the cylinder 152 provided on the lift 56 on the downstream side of the forward movement direction PH1, discharge of the fixed length cable EC formed into twisted cable into the discharge tray 11 is made. The discharge of the fixed length cable EC from the cable clamp 54 is depicted schematically in FIG. 26, which shows the clamp opening, whereafter the fixed length cable EC falls onto the guides 12, which are downwardly angle toward the discharge tray 11. In this manner, the fixed length cables EC travel downwardly along the guides in the direction of the arrow A and are deposited in the discharge tray 11.

Figure 21:
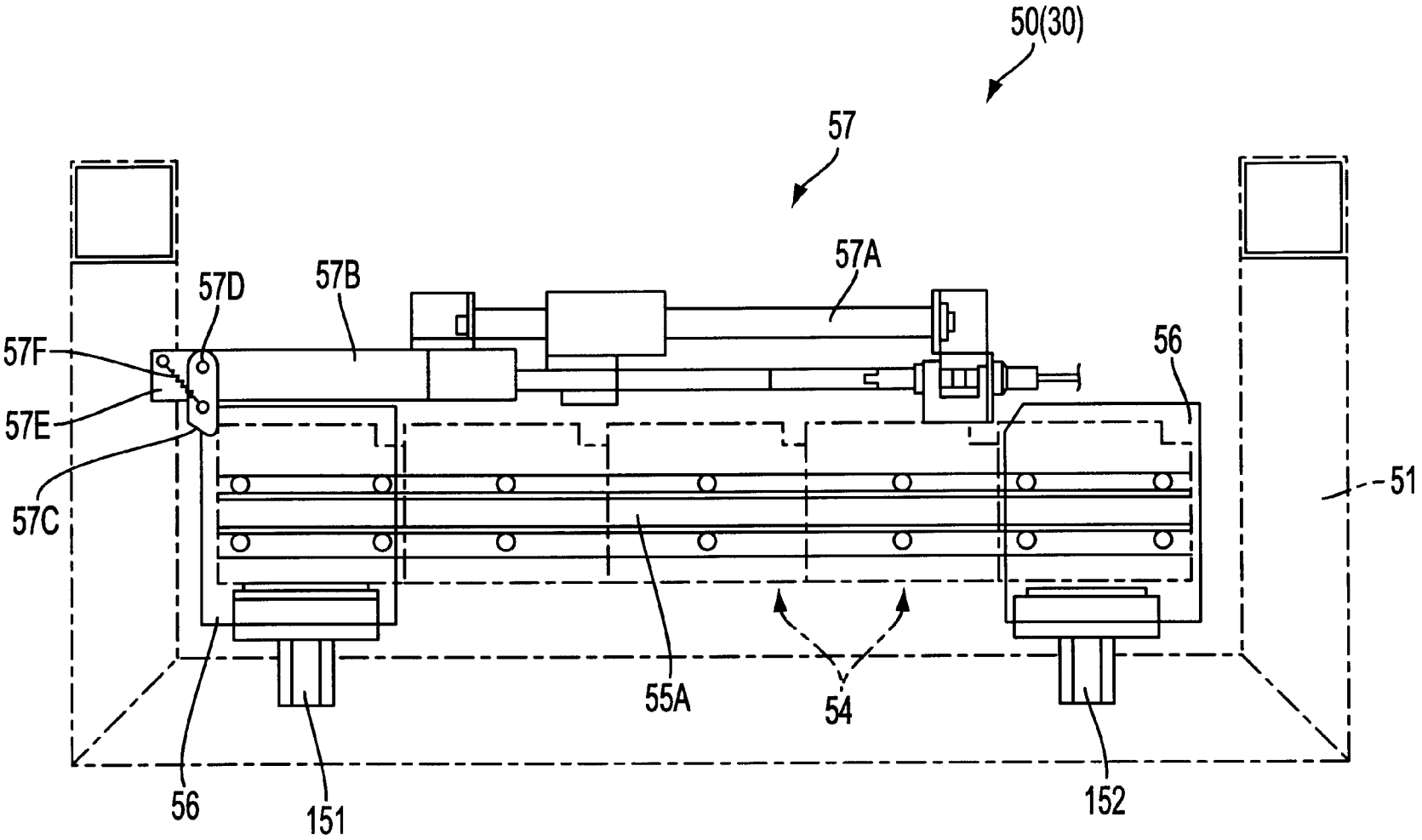
FIG. 21 is an abridged plan view of an upper stage of the B-end side unit of the production unit for twisted cable in FIG. 1.
Figure 22:
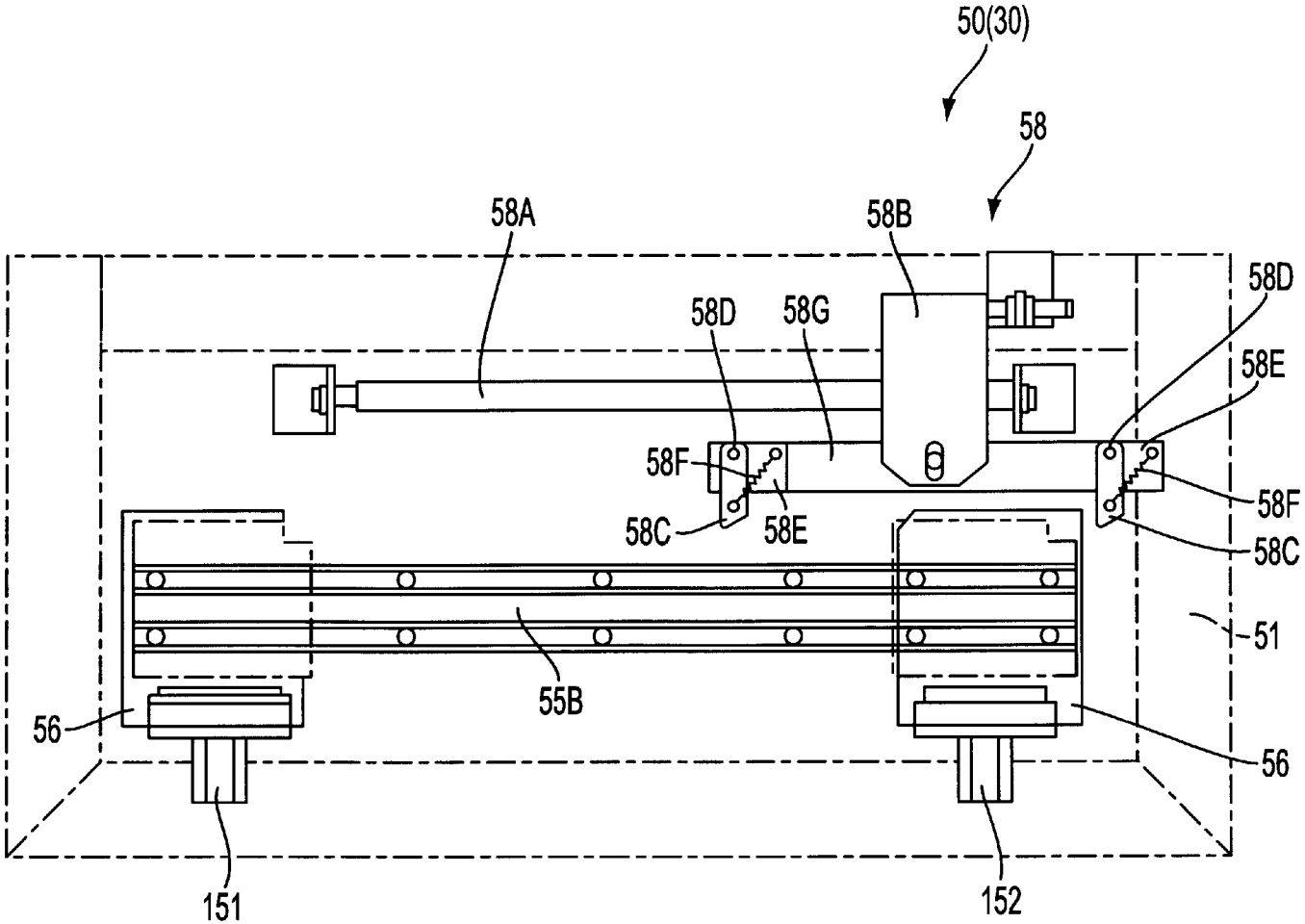
FIG. 22 is an abridged plan view of a lower stage of the B-end side unit of the production unit for twisted cable in FIG. 1.

FIG. 21 is an abbreviated plan view of an upper stage of the B-end side unit in the production unit for twisted cable in FIG. 1, and FIG. 22 is an abbreviated plan view of a lower stage of the B-end side unit in the production unit for twisted cable in FIG. 1.

Referring to these figures, in order to move the clamp 54 forward and rearward synchronized with the cable clamp 44 on the A-end side, the shift units 57, 58 are provided on the B-end side unit 50. The shift units 57, 58 are each disposed on the front side (side facing the A-end side unit 40) of the guide rails 55A, 55B of the corresponding stages 53A, 53B, and include the magnetic type rodless cylinders 57A, 58A to be fitted in parallel with the guide rails 55A, 55B and the sliders 57B, 58B are provided with reciprocating movement by the cylindrical rod 57A, 58A.

The slider 57B of the stage 53A is a metal member of rectangular cross section extending in the longitudinal direction of the guide rail 55A, and has a stopping claw 57C on the upstream side in the forward movement direction. The stopping claw 57C is intermittently rotatable and has an approximate cantilever form by mounting on the pivot pin 57D around the vertical shaft provided thereby. The stop 57E is positioned adjacent the stopping claw 57C on the upstream side in the forward movement direction. The stopping claw 57C is allowed to rotate only in the counter-clockwise direction from the illustrated position, and is biased toward the stop 57E by the tension spring 57F provided on the stop 57E. And, when the cylindrical rod 57A causes forward movement of the slider 57B at a timing to be synchronized with the movement unit 47 on the A-end side as described later, the stopping claw 57C is engaged with the base plate 54A of the cable clamp 54 lying at the most upstream position (on the lift 56 on the upstream side in the forward movement direction), so that displacement by one part can be made toward the downstream side. As a result, the cable clamp 54 on the downstream side is displaced integrally to place the item on the most downstream side onto the lift 56 on the downstream side in the forward movement direction.

On the other hand, the slider 58B on the lower stage 53B is carried in approximately cantilever style by the rodless cylinder 58A and is generally perpendicular to the rodless cylinder 58A. The central part of the drive rod 58G, which lies parallel to the guide rail 55B, is carried by the free end of the slider 58B. On opposite ends of the drive rod 58G, a pair of stopping claws 58C are intermittently rotatable and have an approximately cantilever form by mounting on the pivot pin 58D around the vertical shaft provided thereby. On the upstream side in the direction of rearward movement of each stopping claw 58C, a stop 58E is positioned adjacent each stopping claw 58C to permit rotation thereof only in the clockwise direction from the illustrated position, and each stopping claw 58C is biased toward the stop 58E by the tension spring 58F provided on the above stop 58E. And, as described later, when the rodless cylinder 58A causes rearward movement of the slider 58B at a timing to be synchronized with the movement unit 48 on the A-end side, the stopping claw 58C is engaged with the base plate 54A of the cable clamp 54 lying on the lift 56 on the upstream side in the rearward movement direction to return to the downstream side. As a result, the cable clamp 54 on the lift 56 on the upstream side in the rearward movement direction returns to the lift 56 on the downstream side in the rearward movement direction.

Figure 23:
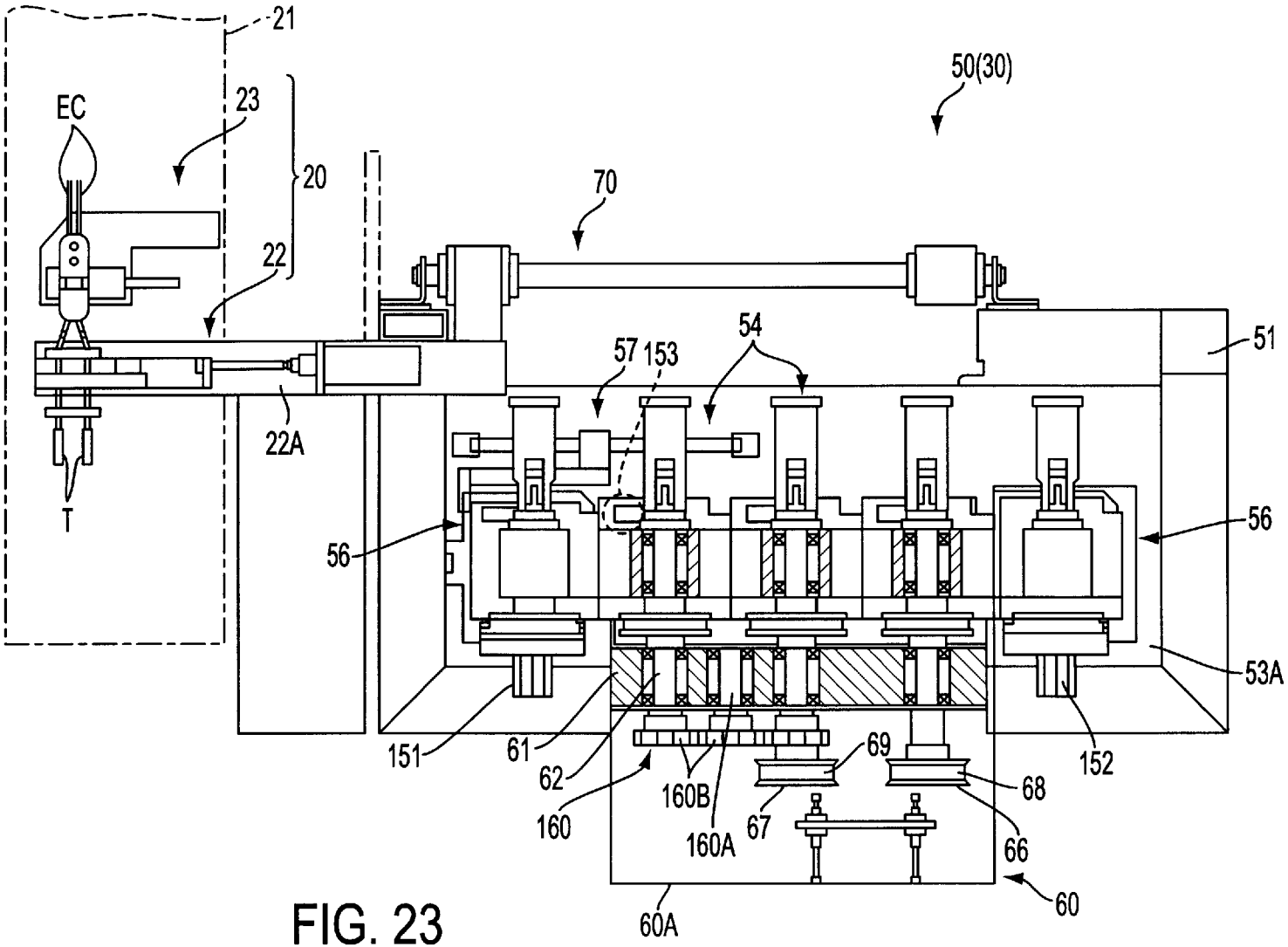
FIG. 23 is an abridged plan view showing a part of the B-end side unit in section, of the production unit for twisted cable of FIG. 1.

Next, referring to FIGS. 18, 19 and 23, the drive unit 60 provided additionally on the upper stage 53A on the B-end side is described. FIG. 23 is an abridged plan view showing a part of the B-end side unit, broken away, for the production unit for twisted cable of FIG. 1.

Referring to these figures, the drive unit 60 includes a block body 61 fixed to the upper stage 53A of the B-end side unit 50 and a rotary shaft 62 rotatably carried by the block body 61 and disposed in coordination with the cable clamp 54 which is carried by the above upper stage 53A.

Each rotary shaft 62 extends horizontally to pass through the block body 61, and is freely rotatable in the bearing 63.

Figure 25:
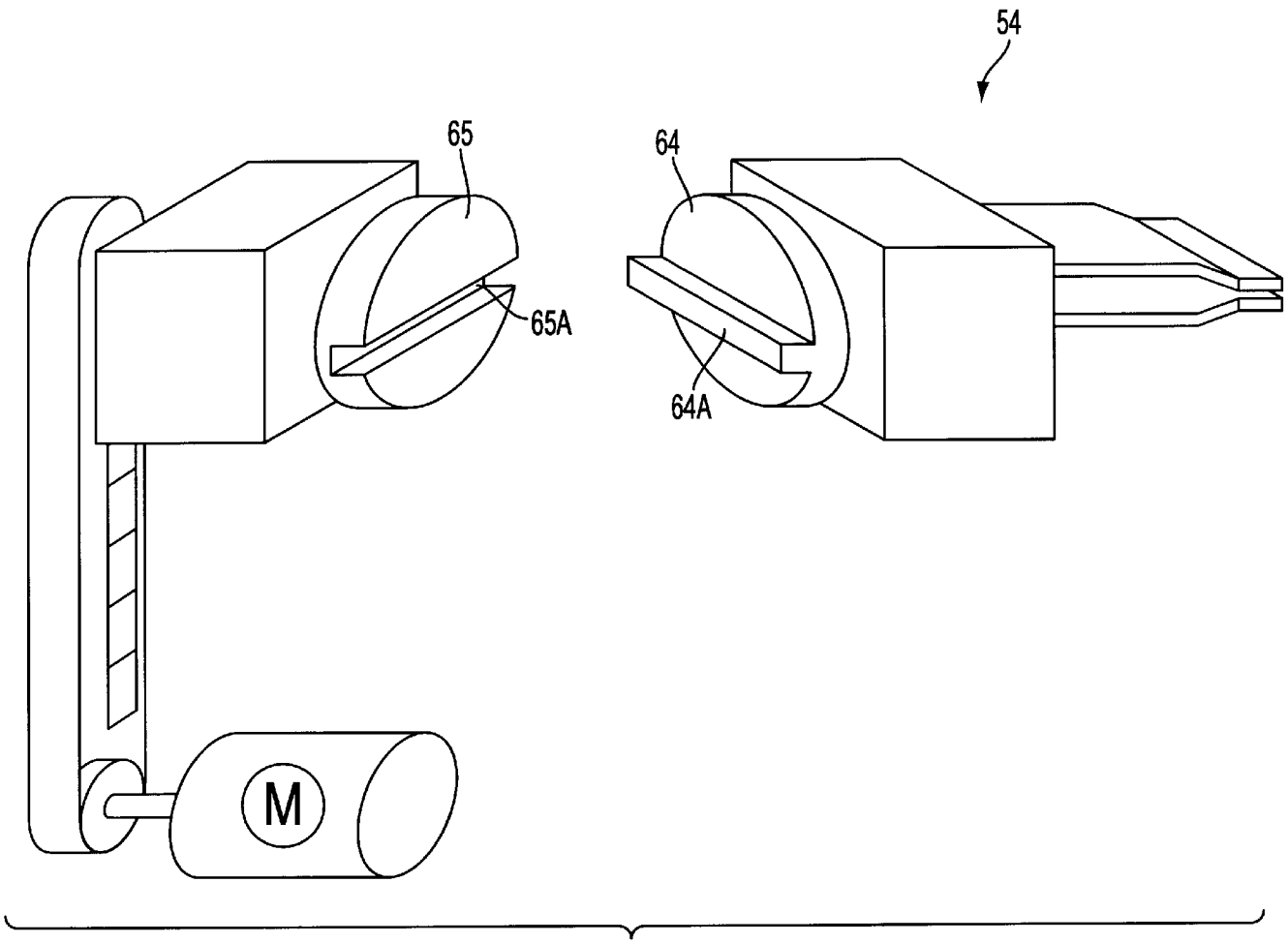
FIG. 25 is a perspective view of an alternative arrangement showing the coupling members for a drive member and the coupling member for a rotatable cable clamp.

At the end of the A-end side, a coupling member 64 (see FIG. 19) is fixed on the driving side and a following side coupling member 65, which is connectable with the driving side coupling member 64, is fixed to the rotary sleeve 54F of each cable clamp 54. The two coupling members 64, 65 are constructed to make it possible to convey a rotary motive force by being connected by mating ribs 64A on coupling member 64 (see FIG. 17) and grooves 65B on coupling member 65 (not shown) which pass through the center of rotation. An alternative arrangement showing the coupling member 65 with groove 65A on the drive member and coupling member 64 with mating rib 64A on the rotatable cable clamp 54 is shown in FIG. 25.

Referring to FIG. 23, the rotary shafts 62 are arranged at equal distances to match the number (in the figure, three) of plural cable clamps 54 to be positioned in parallel on the upper stage 53A. Connection is made so that all the rotary shafts 62, except those most downstream, rotate in unison in the same direction. In the figure, the element 160A is a dummy rotary shaft for the gear unit 160, and 160B is a gear fixed to each rotary shaft 62.

Of the rotary shafts 62, the one at the most downstream end and the one adjacent to the one at the most downstream end (in the figure, the central one) are provided with the pulleys 66, 67, respectively. And, to these pulleys 66, 67, the rotary drive forces of the motors M1, M2 (ref. FIG. 18) are transmitted through the timing belts 68, 69. In the illustrated embodiment, the lower stage 53B is additionally provided with the tension adjusting units 161, 162 for adjusting the tension of the timing belts 68, 69.

The motors M1, M2 are each a concrete stepping motor, designed to rotate the rotary sleeve 54F of the cable clamp 54 by a predetermined number of revolutions at the timing to be described later, thereby rotating the clamp unit 54J which is carried by the rotary sleeve 54F. Here, the motor M2 connected to the most downstream rotary shaft 62 is configured to drive the rotary shaft 62 in opposite directions. The drive unit 60 described above is covered with a cover 60A to ensure safety.

Figure 24:
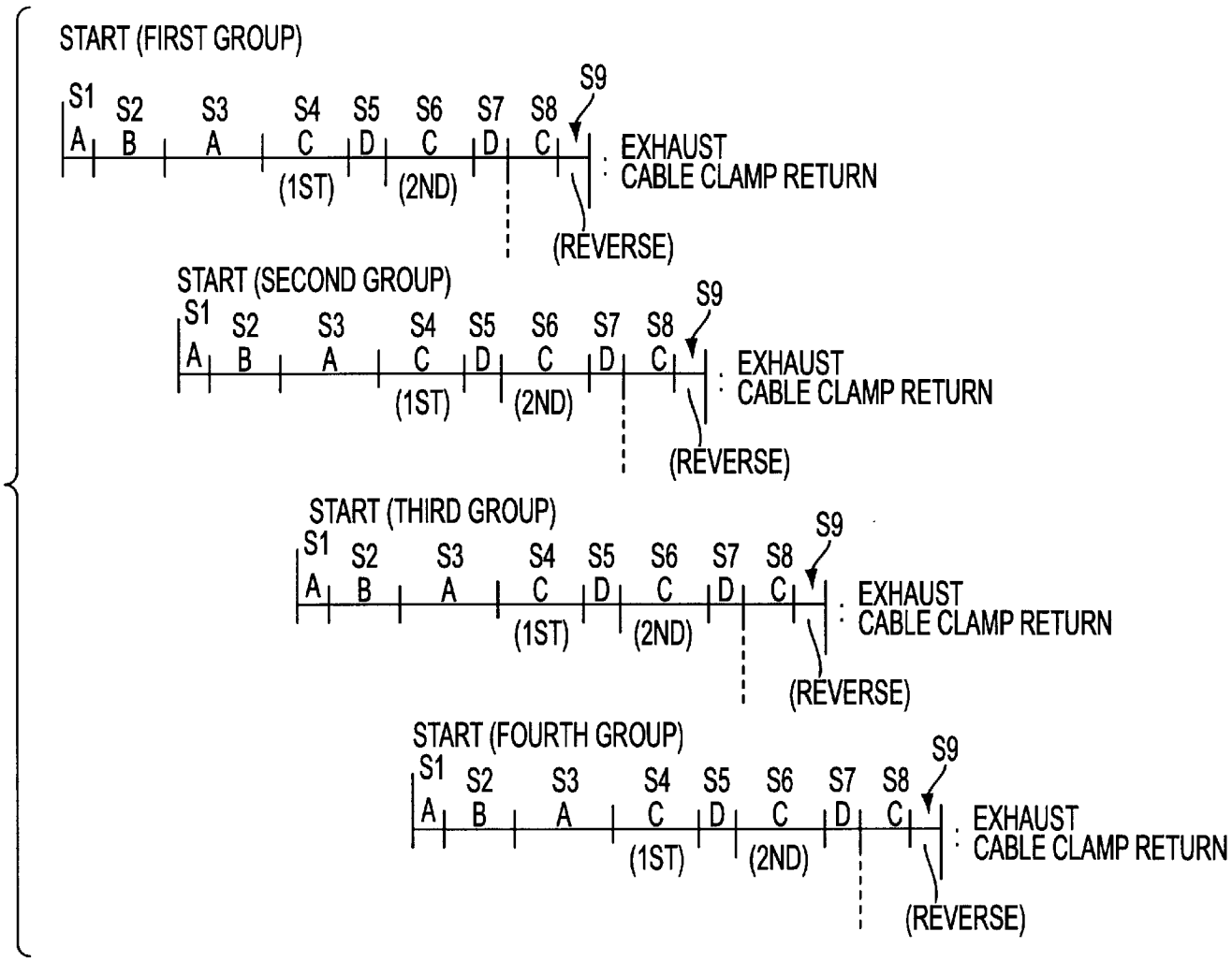
FIG. 24 is a time chart of the production unit for twisted cable given in the embodiment of FIG. 1.

Next, referring to FIG. 24, the operation of the production unit for twisted cable 10 as described above is explained. FIG. 24 is a time chart of the production unit for twisted cable given in the embodiment of FIG. 1.

Referring to FIG. 24, firstly, as shown in Step S1, when the production unit for the fixed length cable 1 produces the fixed length cables EC in a pair and discharges them onto the conveyor 6 (FIG. 1), the discharge hand 7 clamps the B-end side of each fixed length cable EC, and delivers the B-end side of the clamped fixed length cable EC to the clamp 22 which is waiting at the B-end side of the bed 21 (Step S1). In this case, the slider 23 in the vicinity of the clamp 22 clamps the two fixed length cables EC as shown in FIG. 4, and draws each fixed length cables EC in rearward movement on the bed 21 to carry out the straightening operation (Step S2).

Next, with respect to the fixed length cables EC, when the A-end side is delivered to the carrying robot 26 and then the carrying robot 26 and the B-end side slide unit 70 are synchronously displaced, the fixed length cables EC are delivered to the units of 40, 50 of the twisting unit 30 from the straightening unit 20 (Step S3). This delivery is carried out on the lifts 46, 56 on the upstream side of the twisting unit 30.

When both ends of the fixed length cables EC are delivered to the units of 40, 50 of the twisting unit 30, under the condition where the clamp unit 44J provided on the cable clamp 44 of the A-end side is fixed, the clamp unit 54J provided on the cable clamp 54 of the B-end side unit 50 is rotated by the predetermined number of times by the motors M1, M2 of the drive unit 60, with the result that the length adjusted cable EC is twisted by the predetermined number of times between the two (Step S4). When the clamp unit 54J is rotated by the predetermined number of times, the motors M1 and M2 stop once, whereas the moving units 47, 57 provided on the two units 40, 50 cause the corresponding clamp units 44, 54 to move by one piece in the forward movement direction (Step S5). Subsequently, the motors M1 and M2 rotate again to twist further the fixed length cable EC between the clamp units 44J, 54J (Step S6). And, by repeating these twisting motions and shifting motions, the length adjusted cable EC is gradually processed into the twisted cable as it shifts to the downstream side in the forward movement direction.

In the illustrated embodiment, as described above, when the motor M1 attains the predetermined number of twists, the motor M1 stops prior to the motor M2 (Step S8), and, after rotating in reverse direction, it stops simultaneously with the motor M2 (Step S9). By this step, the reaction in the return direction of the fixed length cable EC formed when it is twisted in one direction is removed at the time of it being twisted in reverse direction, and the fixed length cable EC shows plastic deformation under the state of being twisted by the desired twisting amount.

On the other hand, the production unit for fixed length cable 1 produces, even after producing a first set of fixed length cables EC, continuously a second set, a third set, etc. . . . of fixed length cables. These succeeding sets of pairs of fixed length cables EC are so set that, as shown in FIG. 24, by being delivered to the production unit for twisted cable 10 halfway in the step S3 for the preceding set of fixed length cables EC, its first twisting step (Step S4) is synchronized with the second twisting step (Step S6) of the preceding set of fixed length cables EC. By this arrangement, it becomes possible to continuously twist plural sets of the fixed length cables.

In this process, the procedures for circulating the cable clamps 44, 54 are as follows:

First, in Step S3, when the fixed length cable EC is delivered to the cable clamp 44 on the lifts 46, 56, immediately thereafter, the moving units 47, 57 provided on the units 40, 50 cause the corresponding cable clamps 44, 54 to move forward by one increment (equal to the length of the base of each clamp in the direction of movement) along the forward movement direction PH1. By this step, the lifts 46, 56 located upstream in the forward movement direction deliver the cable clamps 44, 54, and on the other hand, the lifts 46, 56 on the downstream side receive the cable clamps 44, 54 previously positioned adjacent thereto. Next, in the step of Step S4, both lifts 46, 56 simultaneously descend, and the cable clamps 44, 54 on the lifts 46, 56 at the downstream end are moved rearward, respectively, and carried onto the lifts 46, 56 on the upstream side in the forward movement direction PH1. By repeating these motions, it becomes possible to cycle the cable clamps 44, 54 in parallel with the cable twisting process as described above.

As described above, according to the preferred embodiment of the present invention, fitting and detaching of the fixed length cable can be made at a fixed position, so that it becomes easy to deliver the fixed length cable EC to the cable clamps 44, 54 produced with the production unit for fixed length cable 10, and automation of the process becomes easy as described above.

Accordingly, there is the remarkable result of facilitating the fitting and detaching of the fixed length cable and contributing to improvement of workability and automation.

Especially, in the event that the drive unit 60 is located at a fixed position and a motive force transmission mechanism transmits the motive force of the drive unit 60 to the drive side cable clamp 54 (coupling members 64, 65), it is possible to rotate the cable clamp 54 under the condition of the drive unit 60 located at a fixed position and to twist the fixed length cable EC. Accordingly, it is unnecessary to have the drive unit 60 per se circulate, thereby making the construction of forward movement mechanism and rearward movement mechanism compact.

Further, due to the additional provision of a straightening unit 20, it is possible to correct the shape of the fixed length cable EC prior to the twisting processing of the fixed length adjusted cable EC. Thus, there is an advantage of improvement in precision of the twisting processing, thereby contributing to improvement of product quality.

Moreover, because the straightening unit 20 draws a pair of fixed length cables EC at one time, two strands of fixed length cables EC can be straightened in one stroke, so that there is an advantage of the expectation of quality improvement in a relatively short processing time.

Furthermore, in the event that the drive unit 60 is to twist the fixed length cable EC a greater amount than the predetermined twisting amount from the upstream side to the downstream side of the forward movement mechanism, followed by twisting the cable in a reverse direction by a predetermined amount at the downstream end of the forward movement mechanism, the fixed length cable EC can show plastic deformation under the condition of being twisted by the desired twisting amount after removal of the reaction in the return direction. Consequently, the process provides higher shaping precision and contributes to quality improvement.

The foregoing embodiments are illustrative only of the preferred modes of the present invention. The present invention is therefore not limited by the above embodiments. For example, it may be arranged to intermittently operate the apparatus 10 from the production unit for the fixed length cable and manually supply a pair of fixed length cables EC to produce a twisted cable. Needless to say, various changes in design are feasible within the scope of claims of the present invention.

As described above, according to the present invention, it is possible to make fitting and detaching of the fixed length cable at a predetermined position, so that the delivery of the fixed length cable produced with the production unit for fixed length cable to the cable clamp is facilitated to result in easy automation.

Therefore, according to the present invention, remarkable results are obtained to make the application and removal of the fixed length cable easy, and to be suitably applicable to improvement of workability and automation compatibility.

Especially, in case the drive unit is located at a fixed position and mechanism is provided for transmitting the motive power of the drive unit to the cable clamp on the drive side, it is possible to rotate the cable clamp under the condition of the drive unit being located at the predetermined position and to give twist processing to the fixed length cable. Accordingly, there is no necessity to have the drive unit per se circulate, and the construction of the forward movement mechanism and rearward movement mechanism are made compact.

When the application station is incidentally provided with a straightening device, the shape of the fixed length cable can be corrected prior to the twist processing of the fixed length cable, so that the precision of twist processing is increased, and there is an advantage that the quality improvement can be expected in a relatively short processing time.

Also, in case the straightening device draws a pair of fixed length cables at one time, it is possible to correct two strands of fixed length cables at a single stroke, and there is an advantage that the quality improvement can be expected in a relatively short processing time.

Further, in case the drive unit is to twist the length adjusted cable in a greater amount than the predetermined twisting amount from the upstream side to the downstream side of the forward movement mechanism, followed by twisting the cable in a reverse direction by a predetermined amount at the downstream end of the forward movement mechanism, it becomes possible to cause the fixed length cable to exhibit plastic deformation under the condition of the reaction in the return direction being removed and being twisted by the desired twisting amount, and therefore a higher shaping precision can be obtained which contributes to quality improvement.

The present invention may be embodied in several forms without departing from the spirit of the essential characteristics thereof.

Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

The present disclosure relates to subject matter contained in priority Japanese Application No. HEI 9-148249, filed on Jun. 5, 1997, which is herein expressly incorporated by reference in its entirety.

What is claimed:

1. A production unit for twisted cable, including parallel arrangements of a plurality of pairs of opposed cable clamps, the clamps at one side for clamping one end of a pair of fixed length cables and the clamps at the other side for clamping the other end of said pair of cables, each pair of cables extending in a substantially longitudinal direction between a respective pair of cable clamps, with one cable clamp of each pair being driven in rotation by a drive unit, and the other cable clamp of each pair being fixed, thereby giving relative twisting rotation to both cables, further comprising:

a forward movement mechanism provided for intermittently advancing each respective pair of cable clamps in a direction transverse to said substantially longitudinal direction;

a supply station from which said fixed length cables are supplied to each respective pair of cable clamps on the upstream side, and a removing station for removing the pair of fixed length cables from the cable clamp; and a rearward movement mechanism for forming an endless form carrying channel with the carrying route formed by said forward movement mechanism and for moving rearwardly the cable clamp previously moved forwardly by said forward movement mechanism.

2. The production unit for twisted cable according to claim 1, wherein said drive units are installed at a plurality of fixed positions to engage a respective one of each pair of clamps which move forward, and a motion transmitting mechanism for transmitting the motive force of each said drive unit to the respective cable clamp on the drive side is provided so that each pair of the cable clamps moved forward by said forward movement mechanism undergoes relative rotation.

3. The production unit for twisted cable according to claim 1, further comprising a straightening device for removing deformation from each pair of cables prior to twisting by drawing the fixed length cables which are provided to said supply station.

4. The production unit for twisted cable according to claim 3, wherein said straightening device comprises:

a fixing device for fixing one end, respectively, of each pair of fixed length cables, a guide device configured to enter between a pair of fixed length cables, a clamping part that clamps each fixed length cable in a state of rolling contact between the guide device, a reciprocating mechanism that reciprocates the guide device and the clamping part integrally along the longitudinal direction of the fixed length cables, and a clamping part driving mechanism that drives the clamping part to a clamping position for clamping the fixed length cable during the time of forward movement and to a releasing position for releasing the fixed length cable at the time of return movement.

5. The production unit for twisted cable according to claim 4, wherein said fixing device acts also as carrying mechanism for carrying an end part of the fixed length cable to the corresponding cable clamp.

6. The production unit for twisted cable according to claim 1, wherein said drive unit twists the fixed length cable in an amount greater than a predetermined twisting amount from the upstream side to the downstream side of the forward movement mechanism, followed by twisting the cable in a reverse direction by a predetermined amount at the downstream end of the forward movement mechanism.

7. A production unit for twisted cable, comprising:

a cable production unit for providing a plurality of pairs of fixed length cables;

a straightening device for removing deformation from each pair of cables prior to twisting by drawing the fixed length cables which are provided by said production unit;

a delivery unit for delivering each respective pair of fixed length cables from said cable production unit to said straightening device;

parallel arrangements of a plurality of pairs of opposed cable clamps, the clamps at one side for clamping one end of a pair of fixed length cables and the clamps at the other side for clamping the other end of said pair of cables, each pair of cables extending in a substantially longitudinal direction between a respective pair of cable clamps, with one cable clamp of each pair being driven in rotation by a drive unit, and the other cable clamp of each pair being fixed, thereby giving relative twisting rotation to both cables of each said pair of cables;

a forward movement mechanism provided for intermittently advancing each respective pair of cable clamps in a direction transverse to said substantially longitudinal direction;

a rearward movement mechanism for forming an endless form carrying channel with the carrying route formed by said forward movement mechanism and for moving rearwardly the cable clamp previously moved forwardly by said forward movement mechanism; and a removing station for removing each pair of fixed length cables from the respective pair of cable clamps after twisting.

8. The production unit for twisted cable according to claim 7, wherein said drive units are installed at a plurality of fixed positions to engage a respective one of each pair of clamps which move forward, and a motion transmitting mechanism for transmitting the motive force of each said drive unit to the respective cable clamp on the drive side is provided so that each pair of the cable clamps moved forward by said forward movement mechanism undergoes relative rotation.

9. The production unit for twisted cable according to claim 7, wherein said straightening device comprises:

a fixing device for fixing one end, respectively, of each pair of fixed length cables, a guide device configured to enter between a pair of fixed length cables, a clamping part that clamps each fixed length cable in a state of rolling contact between the guide device, a reciprocating mechanism that reciprocates the guide device and the clamping part integrally along the longitudinal direction of the fixed length cables, and a clamping part driving mechanism that drives the clamping part to a clamping position for clamping the fixed length cable during the time of forward movement and to a releasing position for releasing the fixed length cable at the time of return movement.

10. The production unit for twisted cable according to claim 9, wherein said fixing device acts also as carrying mechanism for carrying an end part of the fixed length cable to the corresponding cable clamp.

11. The production unit for twisted cable according to claim 10, wherein said drive unit twists the fixed length cable in an amount greater than a predetermined twisting amount from the upstream side to the downstream side of the forward movement mechanism, followed by twisting the cable in a reverse direction by a predetermined amount at the downstream end of the forward movement mechanism.

* * * * *